US009630406B2

(12) United States Patent
Fukaya et al.

(10) Patent No.: US 9,630,406 B2
(45) Date of Patent: Apr. 25, 2017

(54) LIQUID DISCHARGING DEVICE

(71) Applicant: CANON KABUSHIKI KAISHA, Tokyo (JP)

(72) Inventors: Youichi Fukaya, Tokyo (JP); Hidehiko Fujimura, Hachioji (JP); Norihiko Ochi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/358,635

(22) PCT Filed: Nov. 12, 2012

(86) PCT No.: PCT/JP2012/007231

§ 371 (c)(1),
(2) Date: May 15, 2014

(87) PCT Pub. No.: WO2013/073151

PCT Pub. Date: May 23, 2013

(65) Prior Publication Data

US 2014/0313262 A1 Oct. 23, 2014

(30) Foreign Application Priority Data

Nov. 18, 2011 (JP) ..... 2011-252786
Feb. 16, 2012 (JP) ..... 2012-031873
Jul. 24, 2012 (JP) ..... 2012-163988

(51) Int. Cl.
*B41J 2/14* (2006.01)
*B41J 2/16* (2006.01)
*B41J 2/145* (2006.01)

(52) U.S. Cl.
CPC ..... *B41J 2/14209* (2013.01); *B41J 2/145* (2013.01); *B41J 2002/14491* (2013.01)

(58) Field of Classification Search
CPC ..... B41J 2/14209; B41J 2/145; B41J 2/1609; B41J 2/1623
(Continued)

(56) References Cited

U.S. PATENT DOCUMENTS 5,477,247 A * 12/1995 Kanegae ..... 347/20
5,666,144 A * 9/1997 Zhang ..... 347/69
(Continued)

FOREIGN PATENT DOCUMENTS

CN 101352964 A 1/2009
EP 1520701 B1 8/2007
(Continued)

*Primary Examiner* — Matthew Luu
*Assistant Examiner* — Patrick King
(74) *Attorney, Agent, or Firm* — Canon USA, Inc., IP Division

(57) ABSTRACT

The present invention improves rigidity in a joining portion between a substrate and piezoelectric element, and provides a liquid discharging device having improved vibration properties.

A liquid discharging device includes a pressure chamber made up of a space surrounded by a pair of side walls, a floor wall, and a ceiling wall; a substrate configured to make up at least one of the floor wall or ceiling wall; a liquid supplying unit configured to fill the pressure chamber with liquid; and an electrode having a pair of side walls made of piezoelectric elements, configured to apply voltage to the piezoelectric elements in order to shrink the volume of the pressure chamber by deforming the piezoelectric elements and to discharge liquid from the pressure chamber; wherein the tip side face portion of the piezoelectric element is restrained as to the substrate.

13 Claims, 21 Drawing Sheets

(58) Field of Classification Search
USPC ..... 347/40, 50, 69
See application file for complete search history.

(56) References Cited

U.S. PATENT DOCUMENTS

| | | | | |
|---|---|---|---|---|
| 6,074,048 | A * | 6/2000 | Hotomi | B41J 2/04528 347/69 |
| 6,352,336 | B1 * | 3/2002 | Bisberg et al. | 347/55 |
| 6,415,507 | B1 * | 7/2002 | Shimosato et al. | 29/890.1 |
| 6,505,918 | B1 * | 1/2003 | Condie et al. | 347/69 |
| 8,157,354 | B2 * | 4/2012 | Koseki | B41J 2/14209 347/40 |
| 2003/0011660 | A1 * | 1/2003 | Nishi et al. | 347/68 |
| 2003/0193550 | A1 * | 10/2003 | Harajiri et al. | 347/68 |
| 2005/0259135 | A1 | 11/2005 | Mita | |

FOREIGN PATENT DOCUMENTS

| | | | | |
|---|---|---|---|---|
| JP | 04148934 | A | * | 5/1992 |
| JP | H04-148934 | A | | 5/1992 |
| JP | H04-353457 | A | | 12/1992 |
| JP | H06-006375 | B | | 1/1994 |
| JP | H06-218923 | A | | 8/1994 |
| JP | H08-192515 | A | | 7/1996 |
| JP | H10-315472 | A | | 12/1998 |
| JP | H11-207972 | A | | 8/1999 |
| JP | 2000-263787 | A | | 9/2000 |
| JP | 2002-029061 | A | | 1/2002 |
| JP | 2002-052714 | A | | 2/2002 |
| WO | 92/22429 | A1 | | 12/1992 |

* cited by examiner

LIQUID DISCHARGING DEVICE

TECHNICAL FIELD

The present invention relates to a liquid discharging device provided with a discharging unit having a pressure chamber which is partitioned with a side wall (dividing wall) made of piezoelectric elements.

BACKGROUND ART

An inkjet head serving as a liquid discharging device changes ink pressure within a pressure chamber, causes the ink to flow, and discharges ink from a discharge opening, thereby spraying liquid droplets. Particularly, a drop on demand type of head is most generally used. Also, methods to apply pressure to the ink are largely divided into two methods. These are a method to change the pressure of the ink by changing the pressure within the pressure chamber with a driving signal to the piezoelectric elements, and a method to add cause bubbles to occur within the pressure chamber with a driving signal to a resistor, thereby applying pressure to the ink An inkjet head using piezoelectric elements can be created relatively easily by mechanically processing piezoelectric materials in bulk. Also, there is the advantage of having relatively few limits to the ink and being able to selectively coat the recording medium with inks of a wide variety of materials. From such a perspective, recently efforts have increased to use inkjet heads in industrial applications such as the manufacturing of color filters, forming wiring, and so forth.

Of the piezoelectric methods of inkjet heads used industrially, a share mode method is frequently employed. The share mode method uses shear deformation by applying an electrical field to the piezoelectric elements, which have been subjected to polarization treatment, in an orthogonal direction. The piezoelectric elements to be deformed are, for example, the dividing wall portion that is formed by processing an ink groove or the like with a dicing blade in the bulk piezoelectric materials that have been subjected to polarization treatment. On both sides of the piezoelectric elements which are the dividing wall thereof, electrodes to driving the piezoelectric elements are formed, and a nozzle plate on which a nozzle is formed and an ink supply system are formed, whereby an inkjet head is configured (see PTL 1). Such a share mode method inkjet head can be relatively easily manufactured.

In recent years, there have been demand for higher liquid discharge capability of share mode method inkjet heads. Specifically, capability to discharge droplets having higher viscosity at a higher speed, and to discharge more minute droplets, are demanded. In order to do so, piezoelectric elements, which make up a share mode method inkjet head, that are subjected to shear deformation at a higher speed and droplets are applied instantaneously, are demanded.

That is to say, with a share mode method inkjet head, in order to increase the droplet discharge speed, the piezoelectric element displacement energy is increased, and the pressure change within the pressure chamber has to be increased. Therefore, the frequency properties of the piezoelectric elements which are defined by the product of the amount of shear deformation and vibration properties, which is a feature relating to the deformation energy of the piezoelectric elements, has to be increased.

CITATION LIST

Patent Literature

PTL 1: Japanese Patent Publication No. 6-6375

SUMMARY OF INVENTION

Technical Problem

It is generally held that a trade-off relationship between the deformation amount and natural frequency of piezoelectric elements exists. For example, in order to increase the deformation amount of the piezoelectric elements, a method to increase the height of the piezoelectric elements may be considered, but the greater the height of the piezoelectric elements the more the natural frequency decreases. Therefore, there has been a limit to the increase in the vibration properties of the piezoelectric elements.

Also, in order to seal the pressure chamber, the tip face of the tip portion of the piezoelectric element and a plate have to be joined together with adhesive, so as to form a lid with the plate. Thus, in the case of joining the tip face of the tip portion of the piezoelectric element and the plate together with adhesive, the rigidity of the joined portion decreases. When the joined portion has such a decrease in rigidity, the adhesive which is the joined portion can become deformed from the reaction force by the shear deformation of the piezoelectric elements, and a sufficient deformation amount towards the shear deformation is not obtained. Also, when rigidity of the joined portion is low, the natural frequency of the piezoelectric element decreases, and deformation speed decreases. That is to say, when restraint of the tip portion of the piezoelectric element is insufficient, the piezoelectric element cannot be subjected to shear deformation at a high speed, which has been one cause of the decrease in vibration properties of the piezoelectric elements.

Now, the present invention provides a liquid discharging head having improved rigidity in the joined portion between plate and piezoelectric element, and improved frequency properties.

Solution to Problem

A liquid discharging device includes: a pressure chamber made up of a space surrounded by a pair of side walls, a floor wall, and a ceiling wall; a substrate configured to make up at least one of the floor wall or ceiling wall; a liquid supplying unit configured to fill the pressure chamber with liquid; and an electrode having a pair of side walls made of piezoelectric elements, configured to apply voltage to the piezoelectric elements in order to change the volume of the pressure chamber by deforming the piezoelectric elements and to discharge liquid from the pressure chamber; wherein the tip side face portion of the piezoelectric element is restrained as to the substrate.

A liquid discharging device having a plurality of pressure chambers sealed off by side walls made of piezoelectric element, that changes the volume of the pressure chambers according to deformation of the side walls to discharge liquid from the pressure chambers, including: a first member, one face on which a plurality of first piezoelectric elements are formed with spacing therebetween; and a second member, one face on which a plurality of second piezoelectric elements are formed with spacing therebetween, the second member facing the first member so that the second piezoelectric elements are positioned alternately with the first piezoelectric elements, and the side walls are formed by the first and second piezoelectric elements; wherein a first groove, with which the tip side face portion of the second piezoelectric element engages, is formed on one face of the first member on which the first piezoelectric element is formed; and a second groove, with which the tip side face portion of the first piezoelectric element engages, is formed on one face of the second member on which the second piezoelectric element is formed.

Advantageous Effects of Invention

According to the present invention, the tip side face portion of the piezoelectric element is restrained to the plate, whereby rigidity increases, whereby natural frequency of the piezoelectric elements increases. Thus, shear deformation speed of the piezoelectric elements is increased and liquid discharge speed is increased more than with conventional arrangements.

BRIEF DESCRIPTION OF DRAWINGS

FIG. 3A is a partial exploded view of the discharging unit.

FIG. 3B is a partial perspective view of the discharging unit.

FIG. 6A illustrates a case wherein the applied voltage is $V_A=V_B=V_C$.

FIG. 6B illustrates a case wherein the applied voltage is $V_A>V_B$ and the applied voltage is $V_B<V_C$.

FIG. 6C illustrates a case wherein the applied voltage is $V_A<V_B$ and the applied voltage is $V_B>V_C$.

FIG. 7A illustrates the dependence of groove depth to the deformation amount of the piezoelectric elements.

FIG. 7B illustrates the dependence of groove depth to the natural frequency of the piezoelectric elements.

FIG. 7C illustrates the dependence of groove depth to the deformation speed of the piezoelectric elements.

FIG. 13A is a partial exploded view of the discharging unit.

FIG. 13B is a partial perspective view of the discharging unit.

FIG. 15A is a partial schematic diagram of the discharging unit seen from an angle.

FIG. 15B is a partial schematic diagram of the discharging unit seen from another angle.

FIG. 15C is a partial schematic diagram of the discharging unit seen from another angle.

FIG. 15D is a partial schematic diagram of the discharging unit seen from another angle.

FIG. 21A is a diagram illustrating the configuration of the discharging unit of the embodiment.

FIG. 21B is a diagram illustrating a conventional configuration.

FIG. 22A is a diagram illustrating the relation between embedded amount and the Young's Modulus when the pressure chamber height is fixed.

FIG. 22B is a diagram illustrating the relation between embedded amount and the Young's Modulus when the piezoelectric element width is fixed.

FIG. 23A is a diagram illustrating when the Young's Modulus is at 10 GPa.

FIG. 23B is a diagram illustrating when the Young's Modulus is at 4 GPa.

DESCRIPTION OF EMBODIMENTS

Embodiments according to the present invention will be described in detail below with reference to the appended drawings.

First Embodiment

Figure 1:
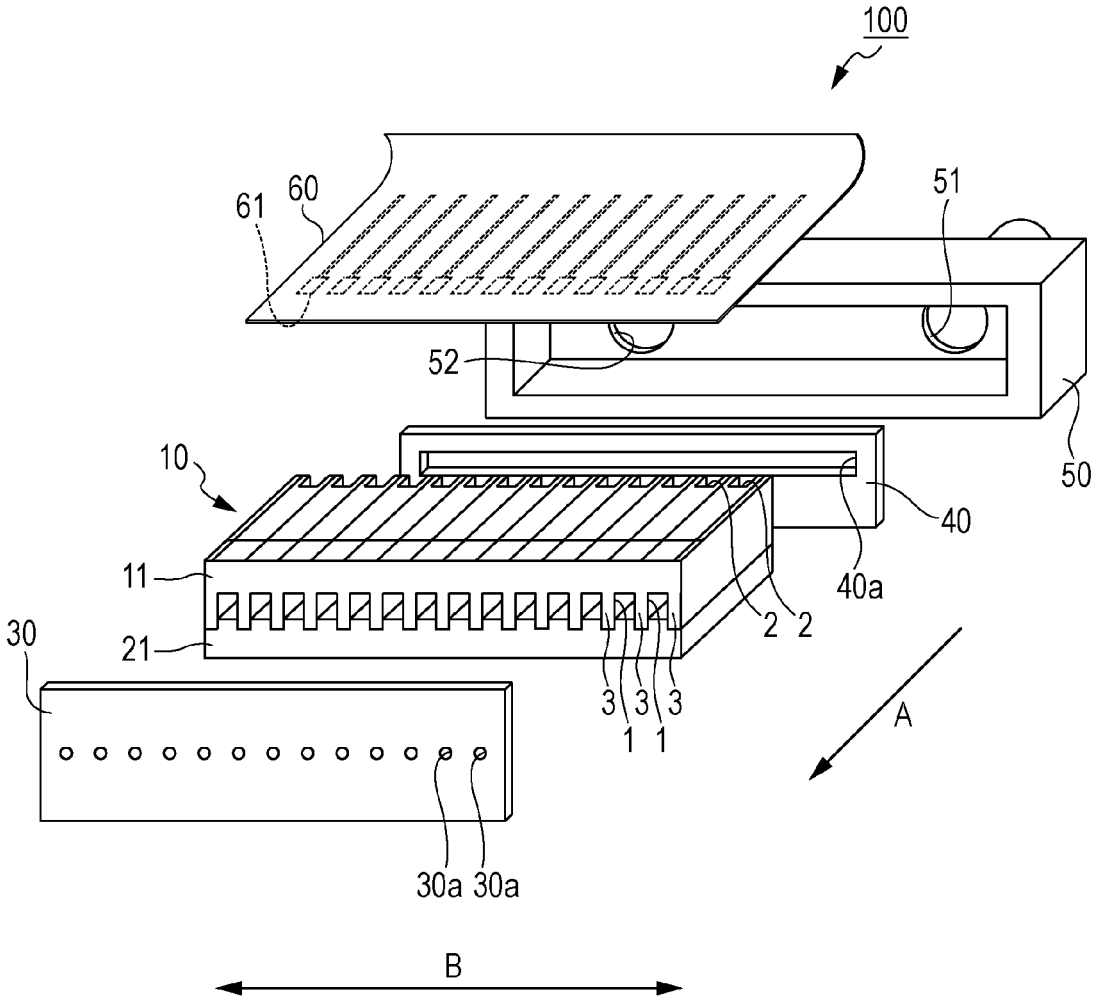
FIG. 1 is a exploded schematic diagram illustrating an inkjet head as an example of a liquid discharging head relating to a first embodiment.

FIG. 1 is a exploded schematic diagram illustrating an inkjet head as an example of a liquid discharging head relating to an embodiment according to the present invention. An inkjet head 100 has a pressure chamber 1 made up of a space surrounded by a pair of side walls 3, floor wall 21, and ceiling wall 11. As illustrated in FIG. 1, a discharging unit 10 may be provided having multiple pressure chambers 1 formed in a row in the width direction B that is orthogonal to the liquid discharge direction A. A nozzle plate 30 having multiple discharge openings 30*a* formed corresponding to the pressure chambers 1 may be disposed on the liquid discharge side face (front face) of the pressure chamber 1. The discharging unit 10 and nozzle plate 30 may be aligned and adhered together so that the positions of the pressure chamber 1 and discharge opening 30*a* match (i.e., so the pressure chamber 1 and discharge opening 30*a* are linked).

Multiple back face grooves 2 that link to the pressure chambers 1 may be formed on the liquid supply side face (back face) of the discharging unit 10. Also, a back face plate 40 on which an ink supply slit 40*a* is formed extending in the width direction B so as to link to all of the back face grooves 2 may be joined to the back face of the discharging unit 10. Further, a manifold 50 on which an ink supply opening 51 and ink collecting opening 52 that link with an ink tank (unshown) may be joined to the back face plate 40. Also, a flexible plate 60 on which multiple signal wirings 61 are formed may be jointed on the face in the direction that is orthogonal to the liquid discharge direction A and width direction B of the discharging unit 10.

Figure 2:
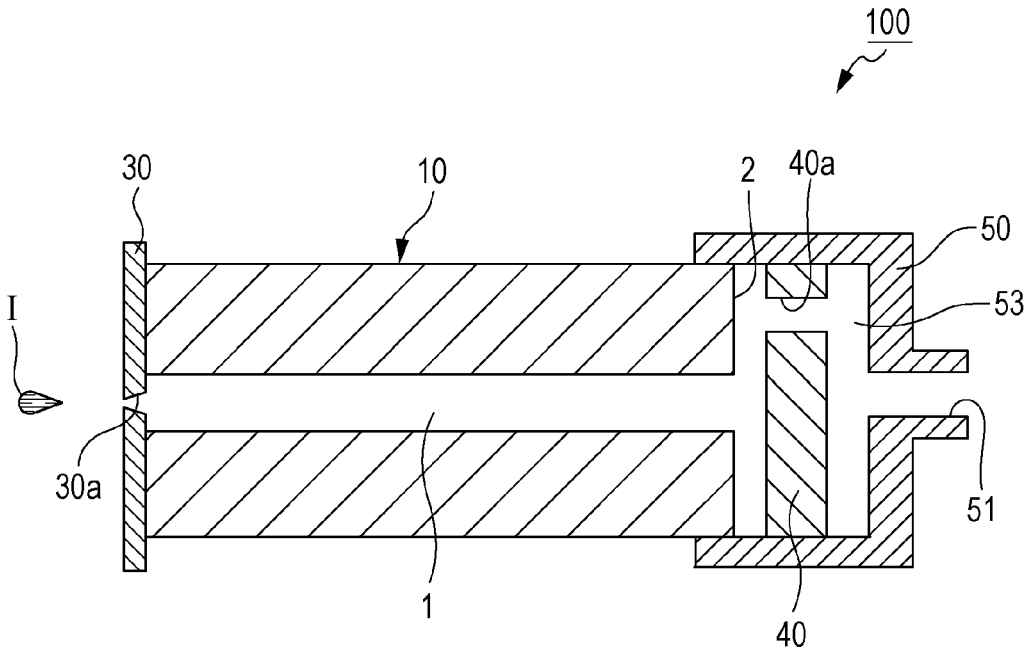
FIG. 2 is a cross-sectional schematic diagram of an ink path illustrating the flow of ink in an inkjet head.

FIG. 2 is a cross-sectional schematic diagram of an ink flow path, illustrating the flow of ink in an inkjet head 100. The ink I supplied from the ink tank (unshown) is supplied to the ink supply slit 40*a* via the ink supply opening 51 and a shared liquid chamber 53 within the manifold 50. Further, the ink I passes through the back face grooves 2 from the ink supply slit 40*a*, fills the pressure chambers 1, and is discharged as appropriate from the discharge openings 30*a*.

The pressure chambers 1 of the discharging unit 10 are formed so as to be sealed off by side walls (dividing walls) 3 made up of polarized piezoelectric materials, as shown in FIG. 1. More specifically, the pressure chambers 1 are formed by being sealed off with a pair of adjacent side walls 3. The side walls 3 are formed so as to extend from the front face where the nozzle plate 30 is attached to the back face where the back face plate 40 is attached (i.e., along the liquid discharge direction A). According to the present embodiment, the side walls 3 are formed in a cuboid shape that extends along the liquid discharge direction A.

The piezoelectric elements making up the side walls 3 have provided thereto a later-described pair of electrodes on both side faces in the direction that is orthogonal to the liquid discharge direction A, i.e. in the width direction B. Voltage is applied in the direction orthogonal to the polarized direction between the pair of electrodes, whereby the side walls 3 are subjected to shear deformation, and the volume of the pressure chamber 1 changes, whereby the ink I which is a liquid is discharged from the pressure chamber 1.

Figure 3A:
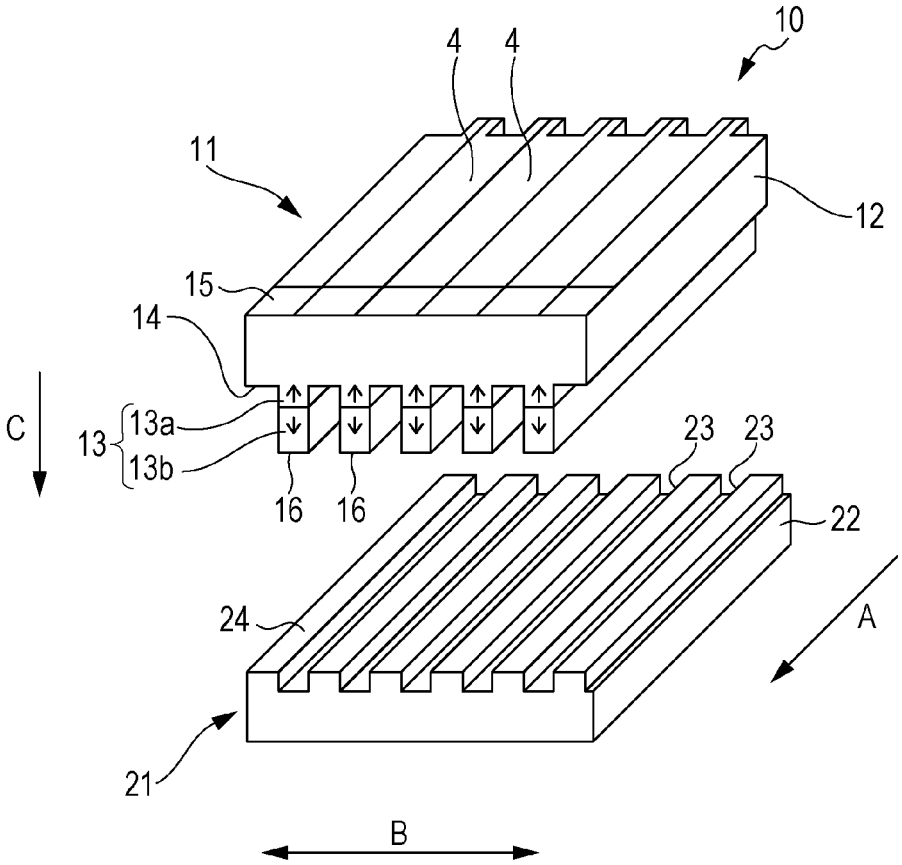
FIG. 3A is a descriptive diagram illustrating a portion of the discharging unit relating to the first embodiment.
Figure 3B:
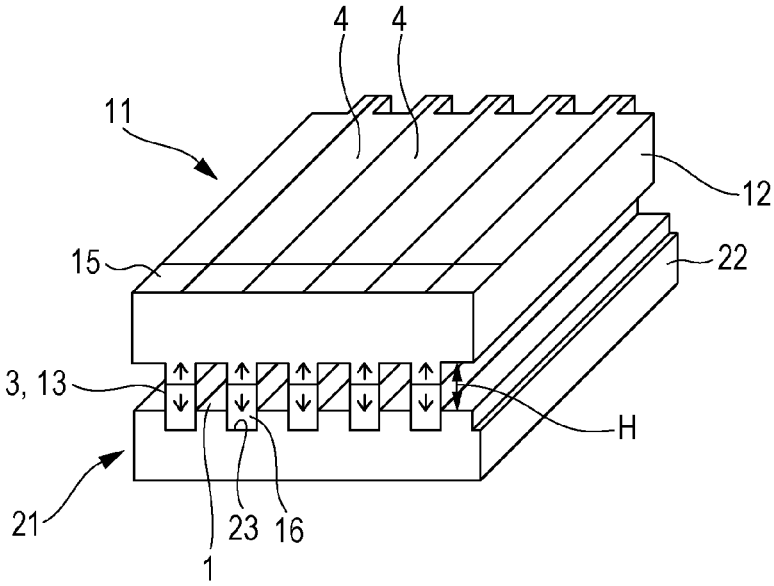
FIG. 3B is a descriptive diagram illustrating a portion of the discharging unit relating to the first embodiment.

The configuration of the discharging unit 10 will be described in detail below. FIGS. 3A and 3B are descriptive diagrams illustrating a portion of the discharging unit 10, FIG. 3A is a partial exploded view of the discharging unit 10, and FIG. 3B is a partial perspective view of the discharging unit 10. The discharging unit 10 has a member 11 and a substrate 21 that is disposed facing the member 11.

The member 11 is formed from a piezoelectric material. The member 11 has a member base unit 12 which is a member main piece formed in a generally plate form. The member 11 also has a piezoelectric element 13 that protrudes from a member base unit 12 toward the substrate 21 in an integrated manner. These piezoelectric elements 13 protrude from the member base unit 12 toward the substrate 21 in a comb-like form. The tip portions 16 in the protruding direction C of the piezoelectric elements 13 are fixed to the substrate 21. The discharging unit 10 only has to have at least one pressure chamber by at least one pair of piezoelectric elements, but the description here will be given for a discharging unit 10 having multiple pressure chambers 1 that are formed in a row in the width direction B which is orthogonal to the liquid discharge direction A.

The multiple piezoelectric elements 13 are formed so as to protrude from one of the faces 14 of the member base unit 12. The multiple piezoelectric elements 13 are formed on one face 14, leaving spaces in between in the width direction B. That is to say, the multiple piezoelectric elements 13 are provided so as to leave spaces in between each other in the width direction B on one face 14 of the member base unit 12. The member base unit 12 herein becomes the floor wall or the ceiling wall of the pressure chamber.

The substrate 21 has multiple grooves 23 that are formed extending along the liquid discharge direction A on a roughly plate-shaped substrate base unit 22. The multiple grooves 23 are formed leaving spaces in between in the width direction B on one face 24 of the substrate base unit 22 (substrate 21) which faces the one face 14 of the member base unit 12, such that the tip portions 16 in the protruding direction C of the piezoelectric elements 13 fit therein. It is favorable for a substrate 21 having a Young's Modulus that is equal to or greater than the Young's Modulus of the member 11 (piezoelectric element 13) to be selected, so that deformation is not caused even at time of shear deformation of the piezoelectric element 13 to be described later. In the case that the member base unit 12 is the floor wall of the pressure chamber, the substrate base unit 22 becomes the ceiling wall of the pressure chamber, and in the case that the member base unit 12 is the ceiling wall of the pressure chamber, the substrate base unit 22 becomes the floor wall of the pressure chamber.

The piezoelectric element 13 may be in a chevron configuration wherein two piezoelectric bodies are pasted together. The two piezoelectric bodies are a base end piezoelectric portion (first piezoelectric portion) 13*a* which is polarized in a first direction that is a direction parallel to the protruding direction C (direction parallel to the side face of the piezoelectric element (or the tip side face portion of the piezoelectric element)), which is formed in an integrated manner with the member base unit 12 and protrudes from the face 14. The other is a tip end piezoelectric portion (second piezoelectric portion) 13*b* which is polarized in the opposite direction from the first direction (second direction).

To describe more specifically, the base end portion in the protruding direction C of the base end piezoelectric portion (first piezoelectric portion) 13*a* is linked (formed) in an integrated manner with the face 14 of the member base unit 12, and the base end portion in the protruding direction C of 13*b* is joined to the tip portion in the protruding direction C of the first piezoelectric portion 13*a*. In FIGS. 3A and 3B, as shown by the arrows in the diagram, the base end piezoelectric portion 13*a* is polarized in the opposite direction from the protruding direction C, and the tip piezoelectric portion 13*b* is polarized in the same direction as the protruding direction C.

The tip portion 16 of the piezoelectric element 13 (the tip portions of the tip piezoelectric portion 13*b*) engages with the groove 23 facing thereto, whereby the tip side face portion is joined to the inner side face portion of the groove, and is restrained. The piezoelectric element 13 becomes the side wall 3, and the pressure chamber 1 is formed at a height of H by a pair of side walls 3 and a member base unit 12 (ceiling wall) and member base portion (floor wall).

The other face 15 of the member base unit 12 has a lead-out electrode 4 that is formed individually corresponding to each pressure chamber 1. A signal wiring 61 of a flexible substrate 60 is joined to the lead-out electrodes 4 that are formed on the member base unit 12, as illustrated in FIG. 1. In this event, the lead-out electrode 4 and signal wiring 61 are joined in an aligned manner.

Figure 4:
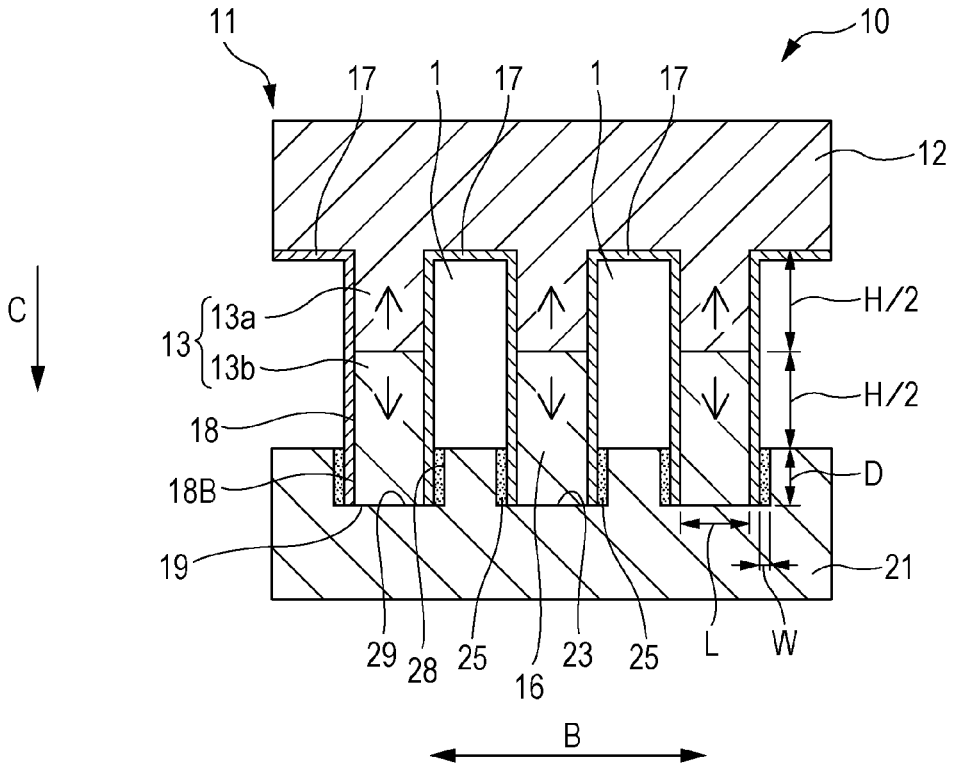
FIG. 4 is a partial segment diagram of the discharging unit relating to the first embodiment.

Next, the configuration of the discharging unit 10 will be described in further detail. FIG. 4 is a partial segment diagram of the discharging unit 10. The piezoelectric element 13 has a side face 18, the normal direction of which is parallel to the width direction B (side face that faces the pressure chamber 1), and a tip face 19, the normal direction of which is parallel to the protruding direction C, wherein the side face 18 and tip face 19 are extended in the direction parallel to the liquid discharge direction A. Let us say that the thickness of the width direction B of the piezoelectric element here is L. A pair of signal electrodes 17 is formed on the side faces 18 of the piezoelectric element 13, and the piezoelectric element 13 is sandwiched between a pair of signal electrodes 17. The signal electrodes 17 are formed so as to surround the pressure chamber 1 in a C shape, and the signal electrodes 17 that are adjacent to each other are electrically insulated.

The signal electrode 17 extends to the engaging region where the side face 18 of the piezoelectric element 13 engages with the groove 23 (tip side face portion 18B), i.e. to the tip portion 16 of the piezoelectric element 13. The tip side face portion 18B which is an extended portion thereof is joined to the inner side face portion of the groove 23, and the tip side face portion 18B is restrained in the groove 23.

The groove 23 has an inner side face portion 28, the normal direction of which is parallel to the width direction B, and a floor face 29, the normal direction of which is parallel to the protruding direction C.

D denotes the length of the tip side face portion of the piezoelectric element, with a favorable range of 20 micrometers or greater and 60 micrometers or less. If D is too short, the rigidity of the joined portion is low, and the advantages of the present invention (to increase rigidity of the joined portion and improve deformation speed) are lessened. The longer D is the more the rigidity of the joined portion is increased, but there may be cases wherein the piezoelectric element becomes too long and the rigidity of the piezoelectric element is decreased, whereby the advantages of the present invention are lessened.

In the event of the tip portion 16 of the piezoelectric element 13 engaging with the groove 23, the tip side face portion 18B of the tip portion 16 of the piezoelectric element 13 and the inner side face portion 28 of the groove 23 are joined together. The tip side face portion 18B of the tip portion 16 of the piezoelectric element 13 and the inner side face portion 28 of the groove 23 may be engaged without any spacing therebetween, or may be faced with an interval in between. Engaging without spacing enables the rigidity to be significantly increased. In the case that a space W is formed between the tip side face portion 18B of the tip portion 16 and the inner side face portion 28 (more specifically, between the electrode face of the signal electrode 17 and the inner side face portion 28), it is favorable for the space W to be filled with an elastic member, and particularly is favorable to be filled with an adhesive 25. The tip face 19 of the piezoelectric element 13 may be joined with the floor face 29 of the groove 23 via an elastic member, but abutting without a space is more favorable. Abutting without a space enables increased rigidity. Thus, the piezoelectric member 11 and substrate 21 form the pressure chamber 1 of a height H, while being mutually joined. If an elastic member fills in the space W, rigidity can be increase, while the portion of the piezoelectric element 13 engaged with the groove 23 can also be subjected to shear deformation, whereby the amount of deformation can be increased.

Figure 5:
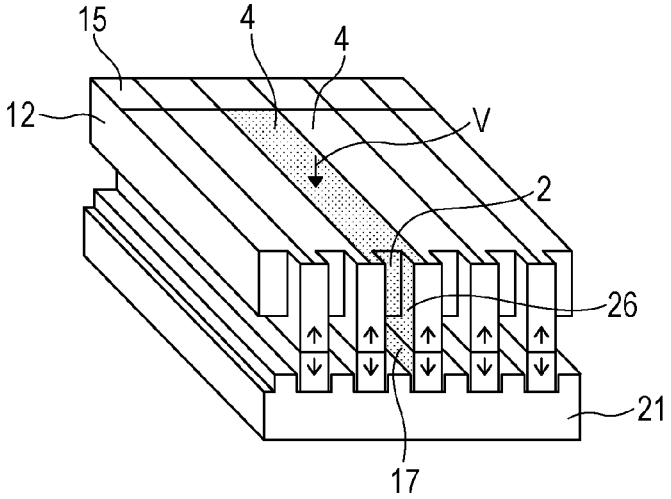
FIG. 5 is a partial schematic view of the pressure chamber, seen from the side of the back face groove forming face of the discharging unit, relating to the first embodiment.

Next, a method to apply voltage to the signal electrode 17 will be described. FIG. 5 is a partial schematic view of the pressure chamber 1, seen from the forming face side of the back face groove 2 of the discharging unit 10. As illustrated in FIG. 5, multiple lead-out electrodes 4 are arrayed on the other face 15 of the member base unit 12, which are electrically connected to the signal wirings 61 of the flexible substrate 60 (FIG. 1). Also, as shown in FIG. 5, a back face electrode 26, which is connected so as to be continued from the signal electrode 17 and electrically conductive with the signal electrode 17, is formed on the inner portion of the back face groove 2, and the back face electrode 26 herein is connected so as to be electrically conductive with the lead-out electrode 4.

In the above described electrode configuration, as illustrated in FIG. 5, upon voltage V being applied to the lead-out electrode 4 from the flexible substrate 60 (FIG. 1), the voltage V is applied to the signal electrode 17 via the back face electrode 26. According to the electrode configuration herein, a driving voltage can be applied from the other face 15 of the member base unit 12 which does not come in contact with the ink, and the applied voltage can be transmitted to the signal electrode 17 via the flat-shaped electrodes 4 and 26. Accordingly, the configuration of inkjet head becomes simple and excellent in conductive reliability.

Figure 6A:
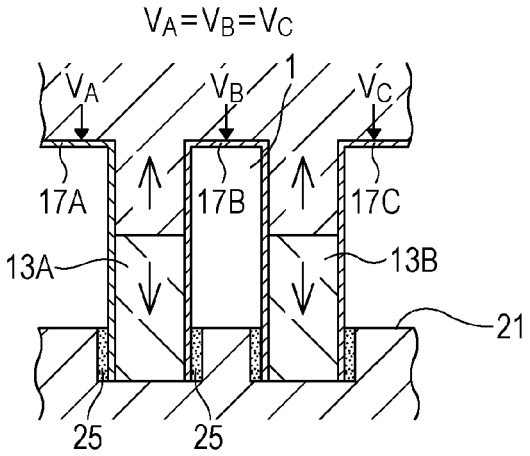
FIG. 6A is a schematic diagram to describe the displacement of the piezoelectric elements and the deformation of the pressure chamber in the event of voltage being applied to the electrodes, relating to the first embodiment.
Figure 6B:
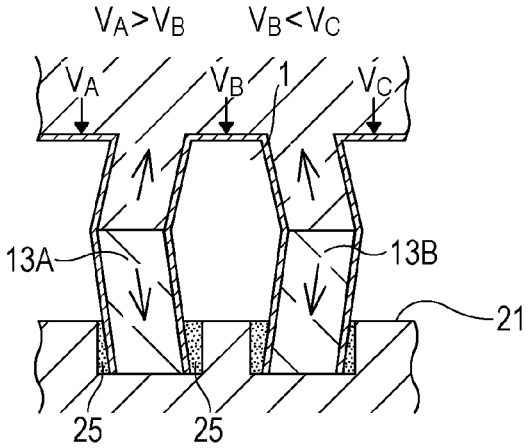
FIG. 6B is a schematic diagram to describe the displacement of the piezoelectric elements and the deformation of the pressure chamber in the event of voltage being applied to the electrodes, relating to the first embodiment.
Figure 6C:
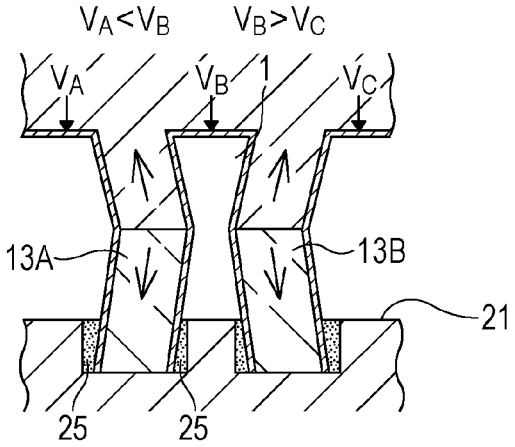
FIG. 6C is a schematic diagram to describe the displacement of the piezoelectric elements and the deformation of the pressure chamber in the event of voltage being applied to the electrodes, relating to the first embodiment.

Next, FIGS. 6A through 6C are schematic diagrams to describe the displacement of the piezoelectric elements 13A and 13B and the deformation of the pressure chamber 1 in the event of voltage being applied to the electrodes, relating to the present embodiment. For the purpose of description here, let us say that voltage $V_A$ is applied to a signal electrode 17A, and voltages $V_B$ and $V_C$ are applied to signal electrodes 17B and 17C, respectively. As illustrated in FIG. 6A, in the case of a ground state wherein the applied voltages are $V_A=V_B=V_C$, the piezoelectric elements 13A and 13B are not deformed.

Next, as illustrated in FIG. 6B, in the case that applied voltage $V_A>V_B$ and applied voltage $V_B<V_C$ hold, voltage $V_A-V_B$ and voltage $V_C-V_B$ results in an electric field being applied to the piezoelectric elements 13A and 13B in the direction orthogonal to the polarization direction, and the piezoelectric elements 13A and 13B are subjected to shear deformation. In this case, the piezoelectric elements 13A and 13B are displaced in a dog-leg shape, in the direction of the cross-sectional area of the pressure chamber 1 expanding. Since the electrical field is applied to the piezoelectric elements 13A and 13B in this manner, the inside of the pressure chamber 1 is filled with liquid.

Next, as illustrated in FIG. 6C, in the case that the applied voltage is $V_A<V_B$ and the applied voltage is $V_B>V_C$, the piezoelectric elements 13A and 13B are displaced in a dog-leg shape, in the direction of the cross-sectional area of the pressure chamber 1 reducing. The electrical field being applied to the piezoelectric elements 13A and 13B in the opposite direction from that shown in FIG. 6B results in the liquid in the first pressure chamber being pressurized, whereby liquid is discharged from the discharge opening 30*a* (FIG. 1).

Thus, according to the present embodiment, the tip portion 16 of the piezoelectric element 13 is engaged with the groove 23 of the substrate 21, and as shown in FIG. 4, the space W between the inner side face portion 28 of the groove 23 and the tip side face portion 18B of the tip portion 16 of the piezoelectric element 13 is filled with an elastic member (preferably an adhesive) 25. In the event that the piezoelectric element 13 is subjected to shear deformation as illustrated in FIG. 6B and FIG. 6C, the elastic member 25 is not subjected to shear deformation as with conventional arrangements, and even if deformed is subjected to compression deformation, whereby the tip portion 16 of the piezoelectric element 13 is effectively restrained in the groove. Accordingly, the rigidity of this joined portion is significantly improved, and the natural frequency of the piezoelectric element 13 is higher than with conventional arrangements, whereby the shear deformation speed of the piezoelectric element 13 increases. Accordingly, the speed of discharge of liquid is increased more than with conventional arrangements.

Also, according to the present embodiment, a pair of electrodes 17 are formed on the side wall faces 18 of the piezoelectric element 13 up to the engaging region of engaging with the groove 23 (i.e., the region of depth D of the groove 23). Accordingly, the portions of the piezoelectric element 13 engaged with the groove 23 can also be subjected to shear deformation.

Also, an elastic member (adhesive is favorable) 25 having a Young's Modulus that is the same or greater than the Young's Modulus of the piezoelectric element 13 may be used, but according to the present embodiment, an elastic member 25 having a Young's Modulus that is less than the piezoelectric element 13 is used. Accordingly, the elastic member 25 is readily compression deformed in the event of shear deformation of the piezoelectric element 13, and shear deformation is induced even at the portions of the piezoelectric element 13 that are engaged with the groove 23, whereby the displacement amount of the piezoelectric element 13 is increased. Thus, rigidity of the piezoelectric element 13 is improved and natural frequency is increased, while the displacement amount of the piezoelectric element 13 can be increased, whereby deformation speed of the piezoelectric element 13 can be improved effectively.

Figure 9:
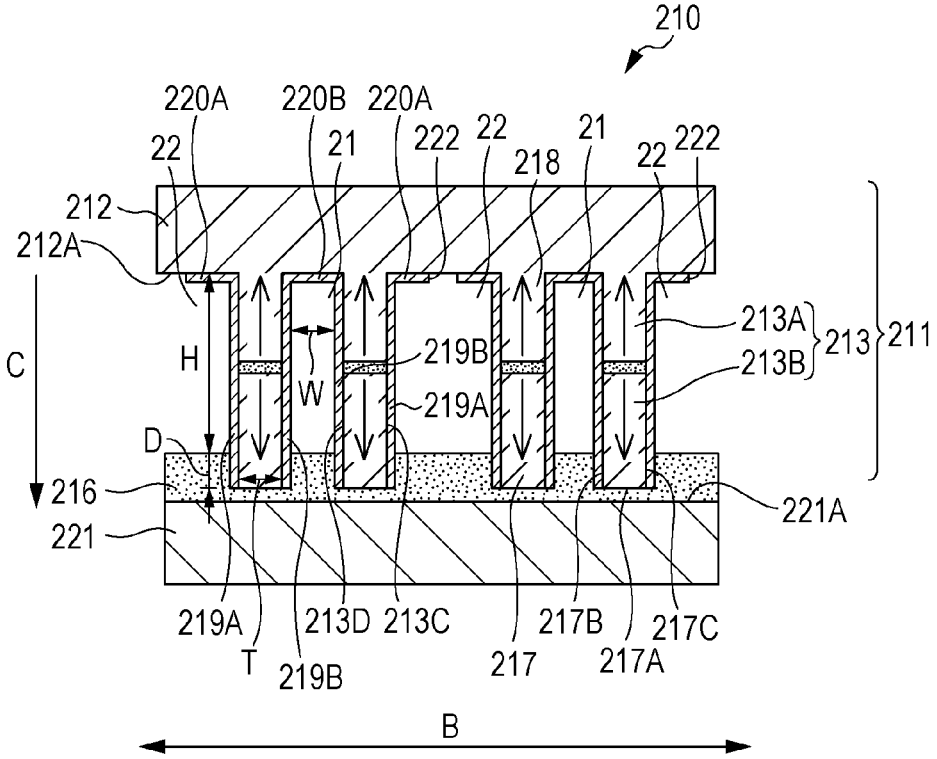
FIG. 9 is a partial segment diagram of a discharging unit relating to the second embodiment.
Figure 10A:
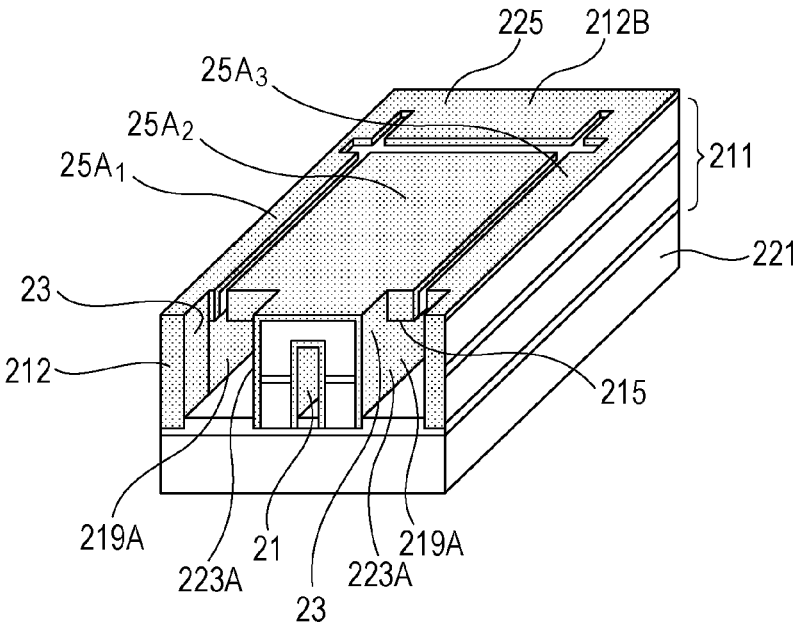
FIG. 10A is a partial schematic diagram relating to the second embodiment.
Figure 10B:
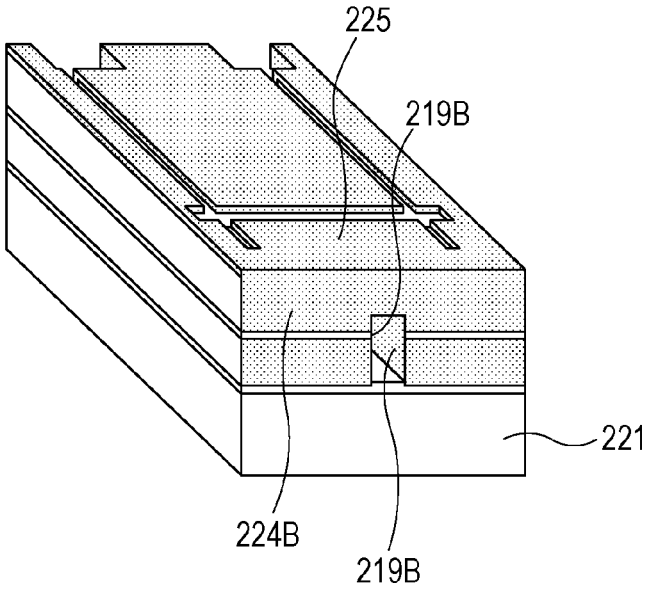
FIG. 10B is a partial schematic diagram relating to the second embodiment.

Also, according to the present embodiment, the tip piezoelectric portion 13*b* is formed so as to be longer in the protruding direction C than the base end piezoelectric portion 13*a*. If the piezoelectric element 13 can be configured to be long, the deformation length of the piezoelectric element 13 becomes longer, whereby the deformation amount can be increased. The region of the piezoelectric element 13 that is longer by the length D of the tip side face portion of the piezoelectric element is restrained via the elastic member 25, but the Young's Modulus of the elastic member 25 is low as compared to the piezoelectric element 13, whereby the deformation amount increase advantage is not lost. Accordingly, the deformation amount of the piezoelectric element 13 can be increased as compared to conventional configurations which are illustrated in FIG. 9 and FIGS. 10A and 10B.

Particularly, the tip piezoelectric portion 13*b* is formed to be longer than the base end piezoelectric portion 13*a* in the protruding direction C, in the amount of the length D of the tip side face portion of the piezoelectric element, whereby the height of the base end piezoelectric portion 13*a* and the height obtained by subtracting the length D of the tip side face portion of the piezoelectric element from the height of the tip piezoelectric portion 13*b* become H/2 and are roughly equal. Thus, the height of the base end piezoelectric portion 13*a* and the height of the portion subtracting the portion of the tip piezoelectric portion 13*b* that engages with the groove 23 are each set as roughly equal to H/2, whereby effective shear deformation is obtained, and liquid can be effectively discharged.

Also, the restraining region by the adhesive 25 expands as the length D of the tip side face portion of the piezoelectric element is lengthened, whereby rigidity of the joining portion is increased. As compared to conventional configurations, the rigidity of joining portion of the piezoelectric element 13 and substrate 21 can be increased, and the natural frequency of the piezoelectric element 13 can be increased.

Note that the present invention is not restricted to the embodiment described above, and numerous modifications can be made within the technical idea of the present invention by one who is skilled in the art. The above embodiment is described for a case wherein the groove 23 is a concave hole, but the groove 23 may be a through hole.

Also, the above embodiment describes a case wherein the piezoelectric element is configured such that two polarized piezoelectric portions are pasted together so as to be mutually in opposite directions, but the present invention is not restricted to this. Even in a case where the piezoelectric element is made of one polarized piezoelectric portion in a direction parallel to the protruding direction (the side face or tip side face portion of the piezoelectric element), the present invention is applicable.

Also, the present embodiment describes an inkjet head used for a printer or the like to serve as the liquid discharge head, but the present invention is not restricted to this, and a head that discharges liquid which includes metallic particles used in the event of forming metal wiring as liquid may be used. Also, the present embodiment describes a piezoelectric element 13 that protrudes from the member base unit 12 of the member toward the substrate 21. That is to say, a case of forming one of the end portions of the piezoelectric element so as to be integrated with the member is described. However, the present invention is not restricted to this, and both ends of the piezoelectric element may be each joined to the substrate. A groove may be formed in at least one of the substrates, and the tip side face portion of the piezoelectric element of at least one of the ends of the piezoelectric element may be restrained as to the inner side face portion of the groove formed in the substrate. It goes without saying that grooves may be formed in both substrates, and the tip side face portions of both ends of the piezoelectric element may be restrained as to the inner side face portions of the grooves formed in the substrates.

Second Embodiment

The first embodiment described an example of joining a tip side face portion of a piezoelectric element as to an inner side face portion of a groove formed in a substrate, but the present embodiment will describe an example of forming an adhesive layer in a substrate, and embedding the tip side face portion of the piezoelectric element into the adhesive layer, thereby restraining the tip side face portion as to the substrate.

FIG. 9 is a partial segment diagram which is an embodiment of a discharging unit 210. A tip portion 217 of a piezoelectric element 213 has a pair of side faces 217B and 217C which are formed on both sides of a tip face 217A and tip face 217A, which are protrusion faces, in the width direction B.

The tip side face portion (the portion of height D (i.e. the embedded amount) of the portion embedded in an adhesive layer 216) of the piezoelectric element 213 touches the adhesive layer 216. The adhesive layer 216 may be continuous over multiple piezoelectric elements 213 in the width direction B.

A signal electrode 219A which is a first electrode is formed on a side face 213C of the piezoelectric element 213 that touches a dummy chamber 22, and a signal electrode 219B which is a second electrode is formed on a side face 213D that touches the pressure chamber 21. The signal electrodes 219A and 219B are provided to the side faces 213C and 213D of the piezoelectric element 213 so as to sandwich the piezoelectric element 213, and are formed so as to extend from the base end portion 218 to the tip portion 217. The present embodiment illustrates an example having a dummy chamber 22 between pressure chambers, but it goes without saying that a configuration not having a dummy chamber such as in the first embodiment may be used.

A floor face electrode 220A, which is connected so as to be continued from the signal electrode 219A and is electrically conductive with the signal electrode 219A, is formed on one face 212A of a member base unit 212 of a member 211. Also, a floor face electrode 220B, which is connected so as to be continued from the signal electrode 219B and is electrically conductive with the signal electrode 219B, is formed. The signal electrode 219A and signal electrode 219B are segmented by a groove 222 formed on the floor face electrode 220A and are electrically insulated.

With the above described configuration, the pressure chamber 21 and dummy chamber 22 are regions that are sealed off by a piezoelectric element 213 which is two adjacent side walls (dividing wall). That is to say, the region is surrounded by side walls (piezoelectric elements) 213, a member base unit 212 which is a ceiling wall or floor wall and a substrate 221 which is a floor wall or ceiling wall. More specifically, the pressure chamber 21 is a region surrounded by the signal electrode 219B, floor face electrode 200B, and adhesive layer 216, and the dummy chamber 22 is a region surrounded by the signal electrode 219A, floor face electrode 220A, adhesive layer 216, and groove 222.

The cross-sectional area of the pressure chamber 21 shown in FIG. 9 is the height H in a direction parallel to the protruding direction C of the pressure chamber 21 times the width W in a direction parallel to the width direction B of the pressure chamber 1. The height H of the pressure chamber 21 is the different where the length (embedded amount) D of the tip side face portion embedded in the adhesive layer 216 is subtracted from the overall height in the protruding direction C of the piezoelectric element 213. The width W of the pressure chamber 21 is the width of the floor face electrode 220B, and the width T of the piezoelectric element 213 is the width in the width direction B from one side face 213C to the other side face 213D.

The tip portion 217 of the piezoelectric elements 213 is embedded in the adhesive layer 216 which is formed in a uniform thickness across the entire face of the face 221A of the substrate 221, together with the signal electrodes 219A and 219B, and touch the adhesive layer 216 via the signal electrodes 219A and 219B. Accordingly, to the tip portion 217 of the piezoelectric element 213, i.e. the portion of the piezoelectric element 213 that is embedded in the adhesive layer 216, an electric field can be applied in the direction that is orthogonal to the direction of polarization.

Next, a method of voltage application to the electrodes 219A and 219B will be described. FIGS. 10A and 10B are partial perspective diagrams of the discharging unit 10, FIG. 10A is a partial perspective diagram viewing the discharging unit 210 from the front face side, and FIG. 10B is a partial perspective diagram viewing the discharging unit 210 from the back face side. FIGS. 10A and 10B illustrate portions corresponding to one pressure chamber 21 and two dummy chambers 22 in the discharging unit 210.

As illustrated in FIG. 10A, multiple lead-out electrodes 25$A_1$, 25$A_2$, and 25$A_3$, and a shared electrode 225 are provided in conjunction to the other base face 212B of the member base unit 212 of the member 211, and are electrically connected to the signal wiring of the flexible substrate.

Also, as illustrated in FIG. 10A, a front face electrode 223A, which is connected so as to be continued from the signal electrode 219A and electrically conductive with the signal electrode 219A, is formed on the front face groove 23, and the front face electrode 223A is connected so as to be electrically conductive with the lead-out electrode 25$A_2$. Next, as illustrated in FIG. 10B, a back face electrode 224B, which is connected so as to be continued from the signal electrode 219B and electrically conductive with the signal electrode 219B, is formed. The back face electrode 224B is connected so as to be electrically conductive with the lead-out electrodes 25$A_1$ and 25$A_3$, via the shared electrode 225.

With the above-described electrode configuration, upon voltage VA being applied to the lead-out electrodes 25$A_2$ from the flexible substrate, the voltage VA is applied to the signal electrode 219A via the front face electrode 223A. Similarly, upon voltage VB being applied to one of the lead-out electrodes 25$A_1$ and 25$A_3$ from the flexible substrate, the voltage VB is applied to the signal electrode 219B via the back face electrode 224B.

From the potential difference between the signal electrodes 219A and 219B, an electrical field is applied to the piezoelectric element 213 in the direction orthogonal to the direction of polarization, and the piezoelectric element 213 is subjected to shear deformation. From this shear deformation of the piezoelectric element 213, the volume of the pressure chamber 21 is changed, and droplets are discharged from the discharge opening that links to the pressure chamber 21.

The operation of the inkjet head 200 according to the present embodiment will be described in detail below. FIGS. 11A through 11D are schematic diagrams to describe the deformation of the pressure chamber 21 by the displacement of two piezoelectric elements 213$_1$ and 213$_2$ which are mutually adjacent in the event that voltage is applied to the electrodes 219A and 219B. For the purposes of description here, let us say that voltage VA is applied to the signal electrode 219A and voltage VB is applied to the signal electrode 219B.

Figure 11A:
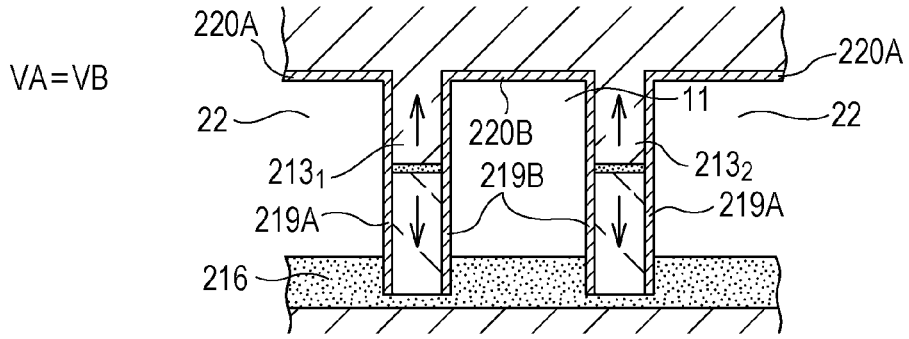
FIG. 11A is a schematic diagram to describe the displacement of the piezoelectric elements and the deformation of the pressure chamber in the event of voltage being applied to the electrodes, relating to the second embodiment.

As illustrated in FIG. 11A, in the case of a so-called ground state where the applied voltage is VA=VB, the piezoelectric elements 213$_1$ and 213$_2$ are not displaced.

Figure 11B:
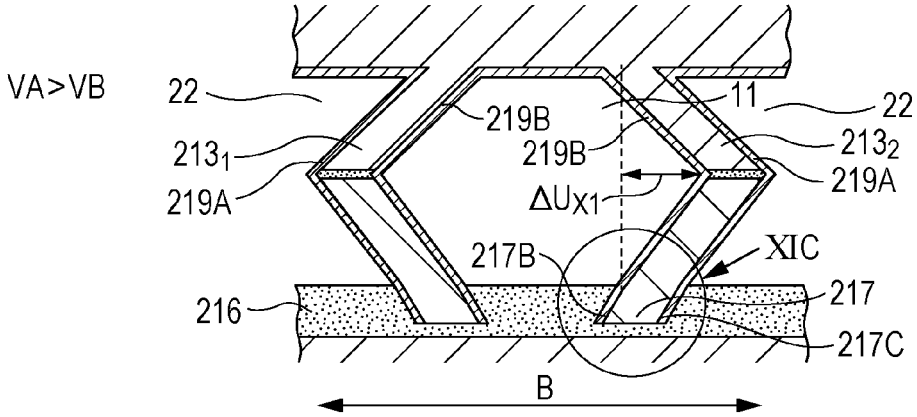
FIG. 11B is a schematic diagram to describe the displacement of the piezoelectric elements and the deformation of the pressure chamber in the event of voltage being applied to the electrodes, relating to the second embodiment.

Next, as illustrated in FIG. 11B, in the case that of applied voltage VA>VB, voltage VA−VB results in an electric field being applied to the piezoelectric elements 213$_1$ and 213$_2$ in the direction orthogonal to the polarization direction, and the piezoelectric elements 213$_1$ and 213$_2$ are subjected to shear deformation. In this case, the piezoelectric elements 213$_1$ and 213$_2$ are displaced in a dog-leg shape, in the direction of the cross-sectional area of the pressure chamber 21 expanding. Since the electrical field is applied to the piezoelectric elements 213$_1$ and 213$_2$ in this manner, the inside of the pressure chamber 21 is filled with ink which is a liquid.

Figure 11C:
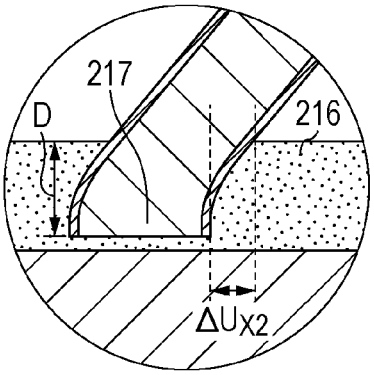
FIG. 11C is a schematic diagram to describe the displacement of the piezoelectric elements and the deformation of the pressure chamber in the event of voltage being applied to the electrodes, relating to the second embodiment.

FIG. 11C is a diagram expanding the region of the adhesive layer 216 and tip portion 217 in FIG. 11B. According to the present embodiment, the adhesive layer 216 has a Young's Modulus that is smaller than that of the piezoelectric element 213. Thus, the tip portion 217 embedded in the adhesive layer 216 can also be displaced.

Figure 11D:
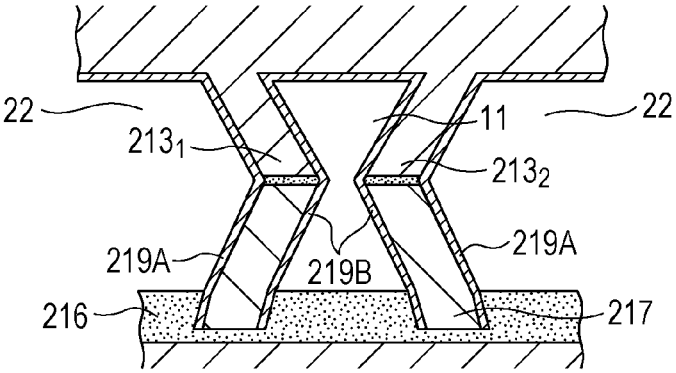
FIG. 11D is a schematic diagram to describe the displacement of the piezoelectric elements and the deformation of the pressure chamber in the event of voltage being applied to the electrodes, relating to the second embodiment.

Next, as illustrated in FIG. 11D, in the case that the applied voltage is VA<VB, the piezoelectric elements 213$_1$ and 213$_2$ are deformed in a dog-leg shape, in the direction of the cross-sectional area of the pressure chamber 1 reducing. Since the electrical field is applied to the piezoelectric elements 213$_1$ and 213$_2$ in the opposite direction from that shown in FIG. 11B, the liquid inside the pressure chamber 21 is pressurized, and droplets which are liquid are discharged from the discharge opening. Note that although not shown in the diagram, in this case, the tip portion 217 is also deformed in the reducing direction.

According to the present embodiment, the piezoelectric body 213B is formed longer than the piezoelectric body 213A by the embedded amount D in the protruding direction C. In other words, the tip portion 217 of the piezoelectric element 213 is embedded in the adhesive layer 216 while coating the one face of the substrate 221, whereby the piezoelectric element 213 is formed so as to be long, with a capacity of the pressure chamber 21 (H*W) that is roughly the same as with conventional arrangements. It is favorable for the adhesive layer 216 to uniformly coat the entire one face of the substrate 221. By having the front face coated uniformly, the length of the tip side face portion, which is the amount of the tip portion of the piezoelectric element embedded in the adhesive layer, can be readily be caused to be the same in each of the piezoelectric elements.

The Young's Modulus E of the adhesive layer 216 is smaller than the Young's Modulus E of the piezoelectric element 213, whereby the tip portion 217 embedded in the adhesive layer 216 can also be displaced in the amount of $U_{x2}$.

Three faces that are the tip face 217A and two side faces 217B and 217C of the tip portion 217 touches the adhesive layer 216. The portions of the two side faces that touch the adhesive layer are called tip side face portions. The adhesive layer 216 is formed uniformly over tip portions 217 of multiple piezoelectric elements 213 in the width direction B. Thus, the tip side face portion of the tip portion 217 of the piezoelectric element 213 is effectively restrained by the adhesive layer 216, rigidity in the event of shear deformation is improved, the natural frequency of the piezoelectric elements 213 is increased, and vibration properties improve. Accordingly, liquid can be discharged at a higher speed than with conventional arrangements.

That is to say, depending on the embedded amount D in the adhesive layer 216, the height H of the pressure chamber 21, and the width T of the piezoelectric elements 213, stress distribution relating to the piezoelectric elements 213 and adhesive layer 216 at the time of displacement changes, and is reflected in the amount of displacement and natural frequency.

For example, if the height H of the pressure chamber 21 divided by the width T of the piezoelectric element 213 is defined as an aspect ratio R(H/T), the displacement amount $U_{x1}$ (FIG. 1B) increases as the aspect ratio R increases. However, the adhesive region in the width direction B of the embedded portion of the piezoelectric element 213 increases and the rigidity of the adhesive layer 216 increases, whereby the displacement effect of the embedded region decreases. Also, if the aspect ratio R is too small, the displacement amount significantly decreases and becomes a cause of discharge error. On the other hand, by increasing the Young's Modulus of the adhesive layer 216, the rigidity of the side faces 217B and 217C improve, leading to improved natural frequency.

In light of the above, vibration properties can be improved effectively more than with conventional arrangements, and a configuration with stable discharging can be obtained, by appropriately adjusting the Young's Modulus E and aspect ratio R of the embedded amount D and adhesive layer 216.

That is to say, according to the present embodiment, signal electrodes 219A and 219B which are first and second electrodes are uniformly provided to the side faces 213C and 213D of the piezoelectric element 213, and tip portion 217 of the piezoelectric element 213 is embedded in the adhesive layer 216 which uniformly coats the one face of the substrate 221. Thus, the embedded portion of the piezoelectric element 213 can also be displaced, and rigidity decrease can be suppressed since the tip side face portions of the side faces 217B and 217C of the tip portion 217 touch the adhesive layer 216, whereby vibration properties can be improved.

Also, according to the present embodiment, the piezoelectric body 213B is formed to be longer in the protruding direction C than the piezoelectric body 213A. if the piezoelectric element 213 can be configured so as to be long, the deformation length of the piezoelectric element 213 becomes longer, whereby deformation amount can be increased. The region that has been lengthened by the amount of the embedded amount D is restrained via the adhesive layer 216, but since the Young's Modulus of the adhesive layer 216 is low as compared to the piezoelectric element 213, the piezoelectric element 213 does not lose the effect of increase in the deformation amount. Accordingly, as compared to conventional configurations, the deformation amount of the piezoelectric element 213 can be increased.

Particularly, piezoelectric body 213B is formed to be longer than piezoelectric body 213A in the protruding direction C, by the amount of the length (embedded amount) D of the tip side face portion, whereby the height of the piezoelectric body 213A and the height obtained by subtracting the length (embedded amount) D of the tip side face portion from the height of the piezoelectric body 213B become H/2 and are roughly equal. Thus, the height of the piezoelectric body 213A and the height of the portion subtracting the length (embedded amount) D of the tip side face portion at the piezoelectric body 213B are each set so as to be roughly equal to H/2 in the piezoelectric element 213. Thereby more effective shear deformation can be obtained, and liquid can be effectively discharged.

Next, a manufacturing method of the discharging unit 210 according to the present embodiment will be described. First, two piezoelectric element substrates that have been subjected to polarization processing are reversed and pasted together with an adhesive, processed to desired dimensions by processing such as grinding, and become a piezoelectric member.

Next, a groove for forming a pressure chamber is processed and a front face groove (23 in FIG. 10) is processed, in the piezoelectric member. By forming a groove, a dividing wall (side wall) serving as a piezoelectric element (actuator) is formed in the piezoelectric member herein. For the groove processes herein, it is favorable to use cutting work with a diamond blade, for example, such that the piezoelectric member does not reach Curie temperature at the time of processing. However, the front face groove (23 in FIG. 10) is not a region that will later operate as an actuator, so laser processing or the like may be used, which does not take the Curie temperature of the member into account.

Next, a conductive layer is applied to the piezoelectric member where the dividing wall is formed. This can be realized by electroless plating or the like. Subsequently, the conductive layer of the tip face (17A in FIG. 9) of the piezoelectric element can be selectively removed by polishing or the like, and the groove (22 in FIG. 9) is processed so as to further segment the conductive layer. Note that the groove processed here (22 in FIG. 9) may be formed with laser processing or cutting work with a diamond blade.

Next, the entire face of one face of the substrate (21 in FIG. 9) is coated uniformly with an adhesive, the tip portion of the dividing wall is embedded in the adhesive and the adhesive is caused to become rigid, whereby the discharging unit 10, of which the tip side face portion of the piezoelectric element is embedded in the adhesive layer (16 in FIG. 9), is obtained.

The coating method of the adhesive on the substrate may use a technique that can adjust the thickness, such as screen printing or bar coater to directly coat the substrate, or the adhesive may be temporarily coated on a film or glass plate and then transferred to the substrate. The adhesive used to form the adhesive layer may be an epoxy, a phenol, or a polyamide, for example.

Subsequently, the front face of the discharging unit is ground and polished to remove the conductive layer and arrange in the desired dimensional shape. Also, a groove to segment the lead-out electrodes is processed as to the upper face of the discharging unit, and individual electrodes which are each electrically segmented are obtained.

With the above-described series of processing, upon forming the discharging unit 210, the nozzle plate, manifold, flexible substrate, and so forth are pasted together, leading to obtaining the inkjet head according to the present embodiment.

Note that the present invention is not restricted to the embodiment described above, and numerous modifications can be made within the technical scope of the present invention by one who is skilled in the art.

The above embodiment describes a case wherein the piezoelectric element is configured such that two polarized piezoelectric portions are pasted together so as to be mutually in opposite directions, but the present invention is not restricted to this. Even in a case where the piezoelectric element is made of one polarized piezoelectric portion in a direction parallel to the protruding direction (the side face or tip side face portion of the piezoelectric element), the present invention is applicable.

Also, the present embodiment describes an inkjet head used for a printer or the like to serve as the liquid discharge head, but the present invention is not restricted to this, and a head that discharges liquid which includes metallic particles used in the event of forming metal wiring as liquid may be used.

Also, the present embodiment describes a piezoelectric element 213 that protrudes from the member base unit 212 of the member toward the substrate 221. That is to say, a case of forming one of the end portions of the piezoelectric element so as to be integrated with the member is described. However, the present invention is not restricted to this, and both ends of the piezoelectric element may be each joined to the substrate.

At least one of the tip side face portions of the piezoelectric element may be embedded in the adhesive layer formed on at least one of the substrates, and restrained by the substrate. It goes without saying that the tip side face portions of both ends of the piezoelectric element may each be embedded in the adhesive layer formed on both substrates, and restrained as to the substrates.

Third Embodiment

The present embodiment will be described in detail with reference to the appended drawings.

Figure 12:
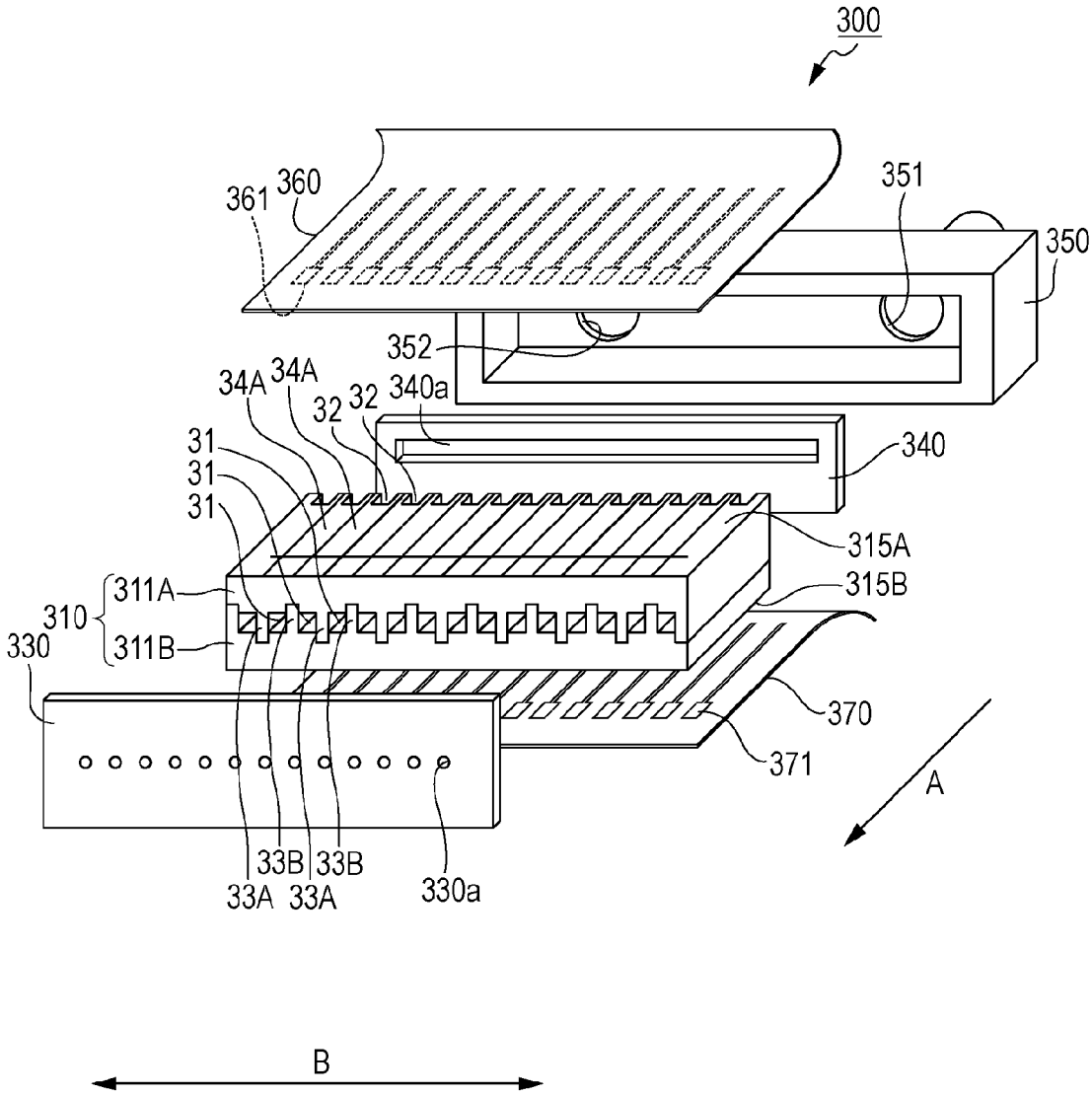
FIG. 12 is a exploded schematic diagram illustrating an inkjet head as an example of a liquid discharging head relating to a third embodiment.

FIG. 12 is an exploded schematic diagram illustrating an inkjet head as an example of a liquid discharging head relating to the present embodiment. An inkjet head 300 illustrated in FIG. 12 has a discharging unit 310 having multiple pressure chambers 31 formed in a row in the width direction B that is orthogonal to the liquid discharge direction A. A nozzle plate 330 having multiple discharge openings 330*a* formed corresponding to the pressure chambers 31 are disposed on the liquid discharge side face (front face) of the discharging unit 310. The discharging unit 310 and nozzle plate 330 may be aligned and adhered together so that the positions of the pressure chamber 31 and discharge opening 330*a* match (i.e., so the pressure chamber 31 and discharge opening 330*a* are linked).

Multiple back face grooves 32 that link to the pressure chambers 31 may be formed on the liquid supply side face (back face) of the discharging unit 310. Also, a back face plate 340 on which an ink supply slit 340*a* is formed extending in the width direction B so as to link to all of the back face grooves 32 may be joined to the back face of the discharging unit 310. Further, a manifold 350 on which an ink supply opening 351 and ink collecting opening 352 that link with an ink tank (unshown) may be joined to the back face plate 340. Also, flexible substrates 360 and 370 are joined to the upper face and lower face of the discharging unit 310, respectively.

According to the present embodiment, the pressure chambers 31 of the discharging unit 310 are formed so as to be sealed off by two adjacent dividing walls 33A and 33B which are made of polarized piezoelectric materials, as illustrated in FIG. 12.

The side walls 33A and 33B are formed as cuboids so as to extend from the front face where the nozzle plate 330 is attached to the back face where the back face plate 340 is attached (i.e., along the liquid discharge direction A).

Electrodes to be described later are provided on both side faces of the dividing walls 33A and 33B.

Voltage is applied in the direction orthogonal to the polarized direction between the electrodes, whereby the dividing walls 33A and 33B are subjected to shear deformation, and the volume of the pressure chamber 31 is changed, whereby the ink I which is a liquid is discharged from the discharge opening 330*a*.

Figure 13A:
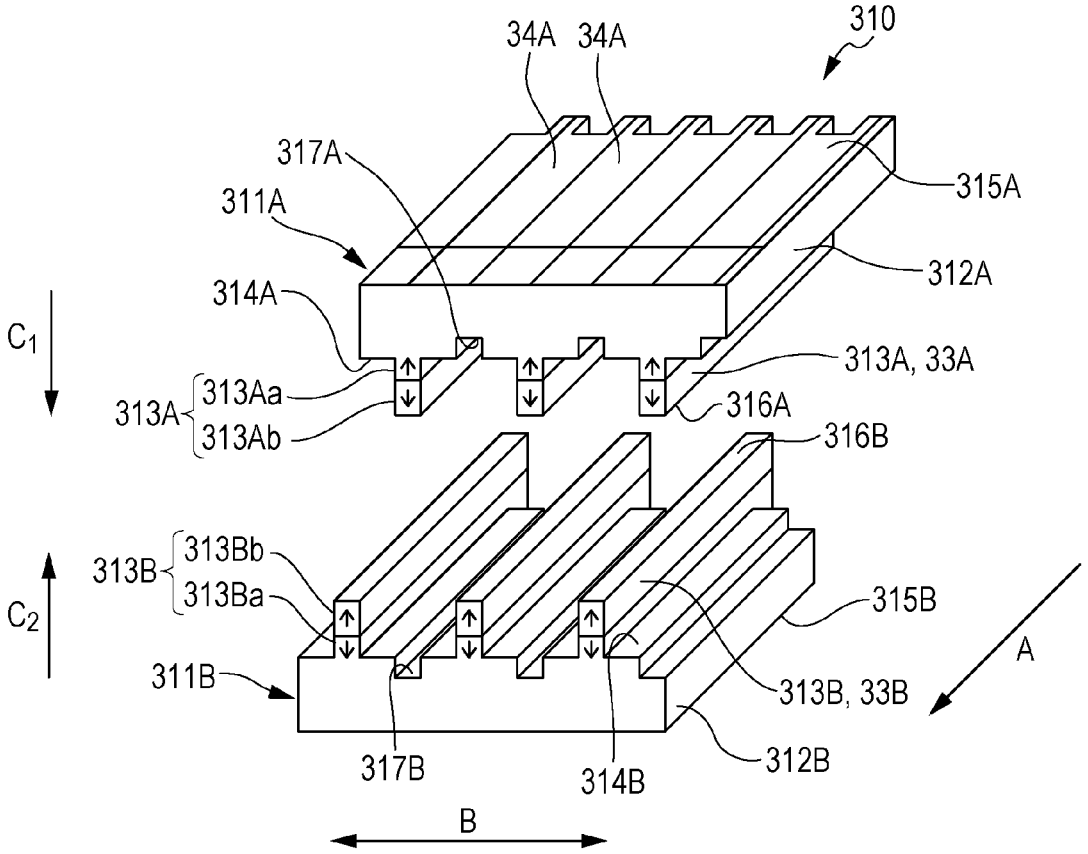
FIG. 13A is a descriptive diagram illustrating a portion of the discharging unit relating to the third embodiment.
Figure 13B:
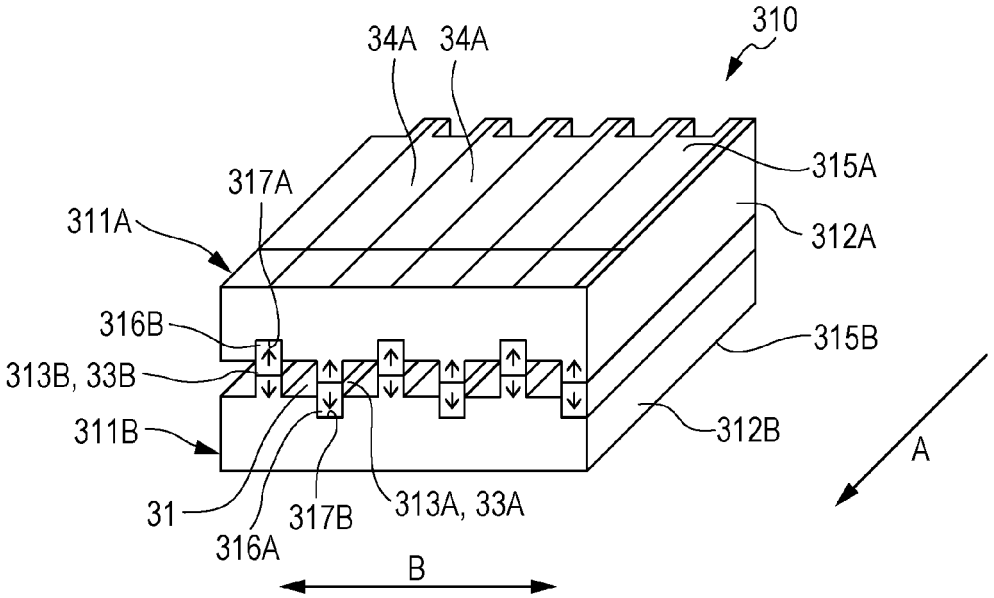
FIG. 13B is a descriptive diagram illustrating a portion of the discharging unit relating to the first embodiment.

The configuration of the discharging unit 310 will be described in detail below. FIGS. 13A and 13B are descriptive diagrams illustrating a portion of the discharging unit 310, FIG. 13A is a partial exploded view of the discharging unit 310, and FIG. 13B is a partial perspective view of the discharging unit 310. The discharging unit 310 has a first member 311A which has a first member base portion 312A and multiple piezoelectric elements 313A that protrude from the first member base portion 312A in a comb-like form. Also, the discharging unit 310 has a second member 311B which has a second member base portion 312B and multiple piezoelectric elements 313B that protrude from the second member base portion 312B in a comb-like form.

The first and second member base portions 312A and 312B are formed in approximate plate shapes. The multiple first piezoelectric elements 313A are formed so as to protrude from one of the faces 314A of the first member 311A, leaving spaces in between each other in the width direction B. That is to say, the multiple first piezoelectric elements 313A are provided to the face 314A of the first member base portion 312A leaving spaces in between in the width direction B. Also, the multiple second piezoelectric elements 313B are formed to as to protrude from one of the faces 314B of the second member 311B, leaving spaces in between each other in the width direction B. That is to say, the multiple second piezoelectric elements 313B are provided to the face 314B of the second member base portion 312B leaving spaces in between in the width direction B.

The second member 311B is caused to face the first member 311A so that the first piezoelectric element 313A and the second piezoelectric element 313B are alternately positioned, and paired. The side wall (dividing wall) 33A made up of the first piezoelectric element 313A and the side wall (dividing wall) 33B made up of the second piezoelectric element 313B are formed. That is to say, the face 314A of the first member base portion 312A and the face 314B of the second member base portion 312B are alternately faced together, so that the first piezoelectric element 313A and second piezoelectric element 313B are alternated. Thus, the pressure chamber 31 can be formed at a pitch that is twice as fine as the pitch of the piezoelectric element 313A (313B), and a high-density pressure chamber 31 can be realized.

A lead-out electrode 34A is formed on the other face 315A of the first member base portion 312A, and a lead-out electrode (unshown) is formed on the other face 315B of a second member base portion 312B, corresponding individually to the pressure chambers 31. A signal wiring 361 of the flexible substrate 360 is joined to the lead-out electrode 34A formed on the first member substrate 312A, as illustrated in FIG. 12. A signal wiring 371 of the flexible substrate 370 is joined to the lead-out electrode (unshown) formed on the second member substrate base portion 312B. In this event, the lead-out electrode 34A and signal wiring 361, and the lead-out electrode (unshown) and signal wiring 371, are each joined in an aligned manner As illustrated by arrows in FIG. 13, the piezoelectric elements 313A and 313B protrude from one of the faces of the substrate. The piezoelectric elements are in a so-called chevron shape, where the piezoelectric material polarized in the protruding direction (height direction) and in the parallel direction and the piezoelectric material polarized in the opposite direction thereof are pasted together.

To describe specifically, the first piezoelectric element 313A protrudes from the face 314A of the first member base portion 312A, and has a first base end piezoelectric portion 313Aa that is polarized in the protruding direction $C_1$ and in the parallel direction. In other words, the first piezoelectric element 313A has a first base end piezoelectric portion 313Aa that is polarized in the orthogonal direction to the face 314A. In FIGS. 13A and 13B the first base end piezoelectric portion 313Aa is polarized in the opposite direction from the protruding direction $C_1$. Further, the first piezoelectric element 313A is fixed to the first base end piezoelectric portion 313Aa, and has a first tip piezoelectric portion 313Ab which is polarized in the opposite direction from the first base end piezoelectric portion 313Aa.

Also, the second piezoelectric element 313B protrudes from the face 314B of the second member base portion 312B, and has a second base end piezoelectric portion 313Ba that is polarized in the protruding direction $C_2$ and in the parallel direction. Further, the second piezoelectric element 313B is fixed to the second base end piezoelectric portion 313Ba, and has a first tip piezoelectric portion 313Bb which is polarized in the opposite direction from the second base end piezoelectric portion 313Ba. In FIGS. 13A and 13B the second base end piezoelectric portion 313Ba is polarized in the opposite direction from the protruding direction $C_2$.

According to the present embodiment, a first groove 317A to which the tip portion 316B of the second piezoelectric element 313B engages is formed on the face 314A, on the first member base portion 312A of the first member 311A. Similarly, a second groove 317B to which the tip portion 316A of the first piezoelectric element 313A engages is formed on the face 314B, on the second member base portion 312B of the second member 311B. The grooves 317A and 317B are formed so as to extend from the front face to the back face of the discharging unit 310, similar to the piezoelectric elements 313B and 313A, so as to engage the piezoelectric elements 313B and 313A. As illustrated in FIG. 13B, the first piezoelectric element 313A engages with the second groove 317B and the second piezoelectric element 313B engages with the first groove 317A, whereby the first member 311A and second member 311B are joined, and the discharging unit 310 is formed. More specifically, according to the present embodiment, the piezoelectric elements 313A and 313B are in a chevron configuration, whereby a portion of the first tip piezoelectric portion 313Ab engages with the second groove 317B, and a portion of the second tip piezoelectric portion 313Bb engages with the first groove 317A.

Figure 14:
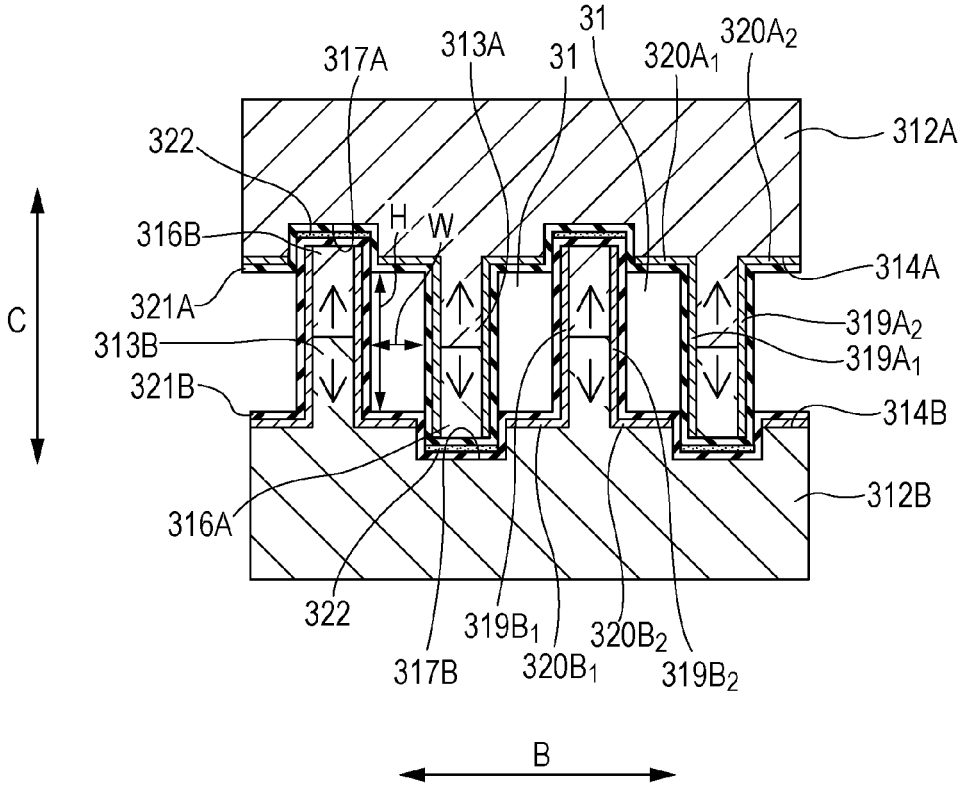
FIG. 14 is a partial segment diagram of the discharging unit relating to the third embodiment.

Continuing, the configuration of the discharging unit 310 will be described in further detail. FIG. 14 is a partial segment diagram of the discharging unit 310. The tip portion 316A of the first piezoelectric element 313A abuts the floor portion of the second groove 317B or engages leaving a space in between, whereby the tip side face portion of the tip portion 316A of the first piezoelectric element 313A and the inner side face portion of the groove are joined, and the tip side face portion is restrained by the groove. Also, the tip portion 316B of the second piezoelectric element 313B abuts the floor portion of the first groove 317A or engages leaving a space in between, whereby the tip side face portion of the tip portion 316B of the second piezoelectric element 313B and the inner side face portion of the groove are joined, and the tip side face portion is restrained by the groove. In the case that the tip portion of the piezoelectric element and the floor portion of the groove are engaged leaving a space in between, this space is filled with an elastic member 322, whereby the substrates 311A and 311B are affixed to one another. It is favorable to use an adhesive for the elastic member 322.

A signal electrode 319$A_1$ is formed on one side face of the first piezoelectric element 313A, and a signal electrode 319$A_2$ is formed on the other side face thereof; a signal electrode 319$B_1$ is formed on one side face of the second piezoelectric element 313B, and a signal electrode 319$B_2$ is formed on the other side face thereof.

A floor face electrode 320$A_1$, which is connected so as to be continued from the signal electrode 319$A_1$ and is electrically conductive with the signal electrode 319$A_1$, is formed on one face 314A of the first member base unit 312A. Also, a floor face electrode 320$A_2$, which is connected so as to be continued from the signal electrode 319$A_2$ and is electrically conductive with the signal electrode 319$A_2$, is formed. The signal electrode 319$A_1$ and signal electrode 319$A_2$ are segmented by a first groove 317A and are electrically insulated.

A floor face electrode 320$B_1$, which is connected so as to be continued from the signal electrode 319$B_1$ and is electrically conductive with the signal electrode 319$B_1$, is formed on one face 314B of the second member base unit 312B. Also, a floor face electrode 320$B_2$, which is connected so as to be continued from the signal electrode 319$B_2$ and is electrically conductive with the signal electrode 319$B_2$, is formed. The signal electrode 319$B_1$ and signal electrode 319$B_2$ are segmented by a second groove 317B and are electrically insulated.

According to the present embodiment, the floor face electrode widths W of the floor face electrodes 320$A_1$, 320$A_2$, 320$B_1$, and 320$B_2$ are segmented by the grooves 317A and 317B so as to have equal widths. That is to say, the multiple piezoelectric elements 313A and 313B are formed so as to have equal spacing between each other, and are formed so that the spacing between two adjacent piezoelectric elements 313A and 313A and the spacing between two adjacent piezoelectric elements 313B and 313B are the same. The groove 317A is formed in the center of two adjacent piezoelectric elements 313A and 313A, and the groove 317B is formed in the center of two adjacent piezoelectric elements 313B and 313B. Thus, the floor face electrodes 320$A_1$, 320$A_2$, 320$B_1$, and 320$B_2$ are formed having mutually equal floor face electrode widths W. the conductive material of the signal electrode 319 and floor face electrode 320 are not particularly restricted, but if a conductive material having a high Young's Modulus, the vibration properties of the piezoelectric element 313 can be improved.

The surfaces of the first piezoelectric element 313A (i.e., signal electrodes 319$A_1$ and 319$A_2$), of the face 314A of the first member base portion 312A (i.e., floor face electrodes 320$A_1$ and 320$A_2$), and of the first groove 317A, are covered with a protective insulating layer 321A. Similarly, the surfaces of the second piezoelectric element 313B (i.e., signal electrodes 319$B_1$ and 319$B_2$), of the face 314B of the second member base portion 312B (i.e., floor face electrodes 320$B_1$ and 320$B_2$), and of the second groove 317B, are covered with a protective insulating layer 321B.

Note that the formation of the region of the protective insulating layer 321A is not restricted by the present embodiment, and may be any configuration that protects the signal electrode 319A and floor face electrode 320A while achieving the function of insulating the nearby signal electrode 319B and floor face electrode 320B. Similarly, the formation of the region of the protective insulating layer 321B is not restricted by the present embodiment, and may be any configuration that protects the signal electrode 319B and floor face electrode 320B while achieving the function of insulating the nearby signal electrode 319A and floor face electrode 320A.

Also, the material used for the protective insulating layers 321A and 321B are not particularly restricted, but it is favorable to select $Al_2O_3$ or the like which has a high Young's Modulus, in an effort to improve rigidity of the joining portion between the groove 317 and piezoelectric element 313, which serve as the restraining region of the piezoelectric elements 313A and 313B.

According to the configuration described above, the pressure chamber 31 is a region sealed off by piezoelectric element 313A serving as the dividing wall 33A and the piezoelectric element 313B serving as the dividing wall 33B, i.e., a region surrounded by the piezoelectric elements 313A and 313B, and the base portions 312A and 312B. Specifically, the region is surrounded by the signal electrodes 319A and 319B and the floor face electrodes 320A and 320B.

The cross-sectional area of the pressure chamber 31 is the pressure chamber height H times the pressure chamber width W as illustrated in FIG. 14. The pressure chamber height H is the difference between the overall height of the first piezoelectric element 313A in the protruding direction C and the length of the tip side face portion of the tip portion 316A inserted into the second groove 317B. Also, the pressure chamber height H is the difference between the overall height of the second piezoelectric element 313B in the protruding direction C and the length of the tip side face portion of the tip portion 316B inserted into the first groove 317A. The pressure chamber width W is the width of the floor face electrode 320A (320B).

Next, a method for applying voltage to the electrodes will be described. FIGS. 15A through 15D are schematic views of a pressure chamber 31, seen from the side of the back face groove 32 forming face of the discharging unit 310. Note that FIGS. 15A through 15D schematically illustrate the same region of the pressure chamber 31 from different viewpoints, to facilitate understanding.

Figure 15A:
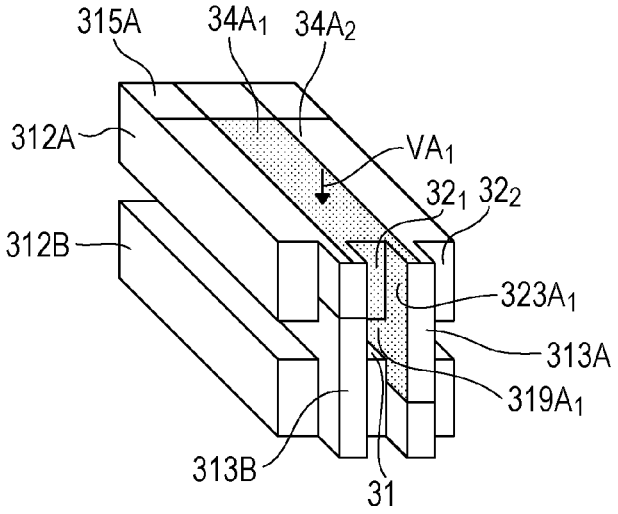
FIG. 15A is a schematic view of a pressure chamber, seen from the side of the back face groove forming face of the discharging unit, relating to the third embodiment.
Figure 15B:
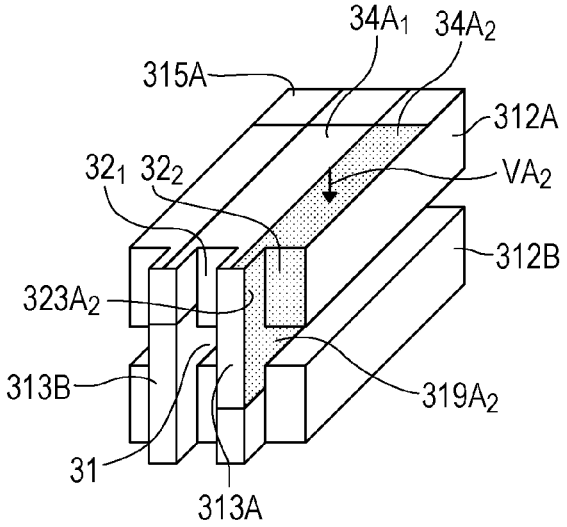
FIG. 15B is a schematic view of a pressure chamber, seen from the side of the back face groove forming face of the discharging unit, relating to the third embodiment.

As illustrated in FIGS. 15A and 15B, multiple lead-out electrodes 34$A_1$, 34$A_2$, and so forth are provided to the other face 315A of the first member base portion 312A, and are electrically connected with the signal wiring 361 of the flexible substrate 360 (FIG. 12). Also, as illustrated in FIGS. 15C and 15D, multiple lead-out electrodes 34B1, 34B2, and so forth are provided to the other face 315B of the second member base portion 312B, and are electrically connected with the signal wiring 371 of the flexible substrate 370 (FIG. 12).

Also, as illustrated in FIG. 15A, a back face electrode 323$A_1$, which is connected so as to be continued from the signal electrode 319$A_1$ and electrically conductive with the signal electrode 319$A_1$, is formed on the inner portion of the back face groove 32$_1$. The back face electrode 323$A_1$ herein is connected so as to be electrically conductive with the lead-out electrode 34$A_1$.

Also, as illustrated in FIG. 15B, a back face electrode 323$A_2$, which is connected so as to be continued from the signal electrode 319$A_2$ and electrically conductive with the signal electrode 319$A_2$, is formed on the inner portion of the back face groove 32$_2$. The back face electrode 323$A_2$ herein is connected so as to be electrically conductive with the lead-out electrode 34$A_2$.

Figure 15C:
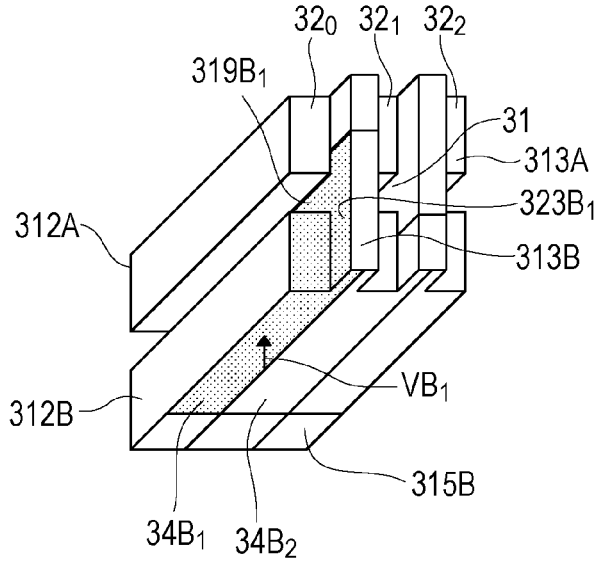
FIG. 15C is a schematic view of a pressure chamber, seen from the side of the back face groove forming face of the discharging unit, relating to the third embodiment.
Figure 15D:
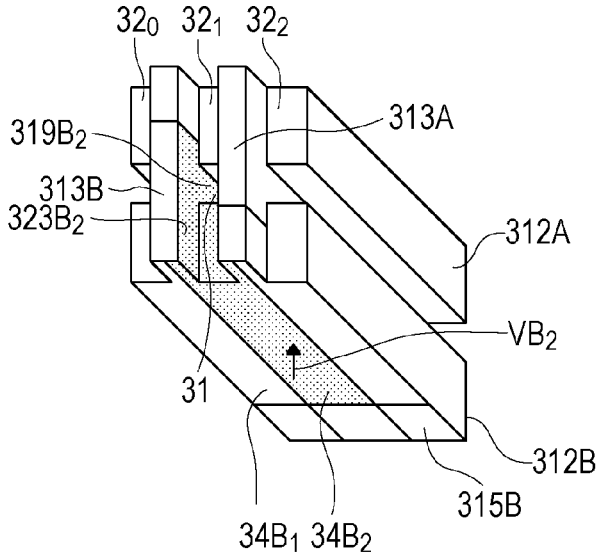
FIG. 15D is a schematic view of a pressure chamber, seen from the side of the back face groove forming face of the discharging unit, relating to the third embodiment.

Also, as illustrated in FIG. 15C, a back face electrode 323$B_1$, which is connected so as to be continued from the signal electrode 319$B_1$ and electrically conductive with the signal electrode 319$B_1$, is formed on the inner portion of the back face groove 32$_0$. The back face electrode 323$B_1$ herein is connected so as to be electrically conductive with the lead-out electrode 34$B_1$.

Also, as illustrated in FIG. 15D, a back face electrode 323$B_2$, which is connected so as to be continued from the signal electrode 319$B_2$ and electrically conductive with the signal electrode 319$B_2$, is formed on the inner portion of the back face groove 32$_1$. The back face electrode 323$B_2$ herein is connected so as to be electrically conductive with the lead-out electrode 34$B_2$.

According to the above-described electrode configuration, as illustrated in FIG. 15A, upon voltage $VA_1$ being applied to the lead-out electrode 34$A_1$ from the flexible substrate 360 (FIG. 12), voltage $VA_1$ is applied to the signal electrode 319$A_1$ via the back face electrode 323$A_1$. Also similarly, as illustrated in FIG. 15B, upon voltage $VA_2$ being applied to the lead-out electrode 34$A_2$ from the flexible substrate 360 (FIG. 12), voltage $VA_2$ is applied to the signal electrode 319$A_2$ via the back face electrode 323$A_2$.

Also, as illustrated in FIG. 15C, upon voltage $VB_1$ being applied to the lead-out electrode 34$B_1$ from the flexible substrate 370 (FIG. 12), voltage $VB_1$ is applied to the signal electrode 319$B_1$ via the back face electrode 323$B_1$. Also similarly, as illustrated in FIG. 15D, upon voltage $VB_2$ being applied to the lead-out electrode 34$B_2$ from the flexible substrate 370 (FIG. 12), voltage $VB_2$ is applied to the signal electrode 319$B_2$ via the back face electrode 323$B_2$.

According to this electrode configuration, driving voltage can be applied from the other faces 315A and 315B of the member base portions 312A and 312B which does not touch the ink, and the applied voltage can be transmitted to the signal electrode 319 via flat-shaped electrodes. Accordingly, the configuration of inkjet head becomes simple and excellent in conductive reliability.

Figure 16A:
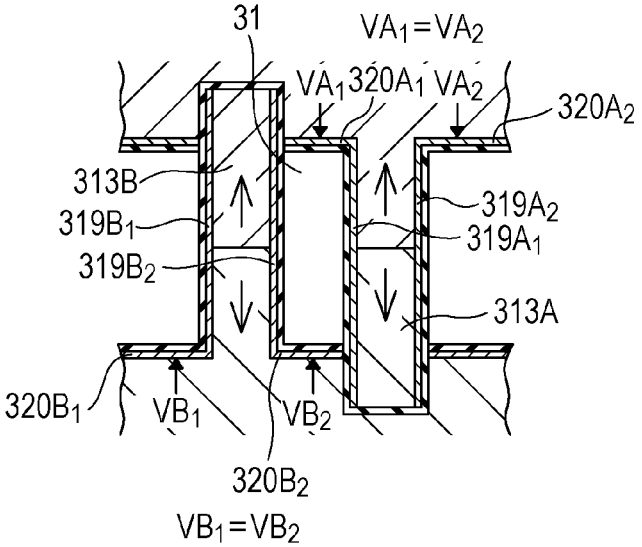
FIG. 16A is a schematic diagram to describe the displacement of the piezoelectric elements and the deformation of the pressure chamber in the event of voltage being applied to the electrodes, relating to the third embodiment.
Figure 16B:
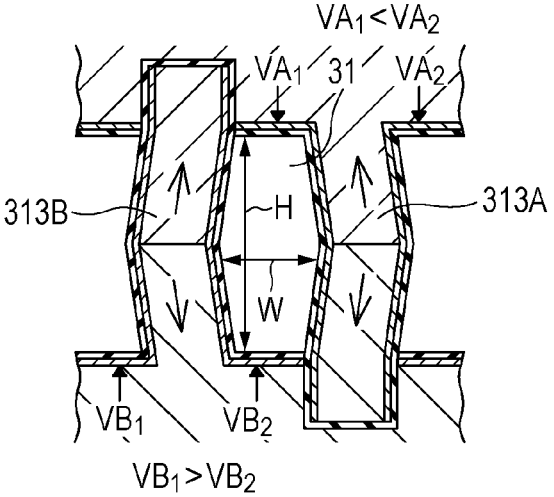
FIG. 16B is a schematic diagram to describe the displacement of the piezoelectric elements and the deformation of the pressure chamber in the event of voltage being applied to the electrodes, relating to the third embodiment.
Figure 16C:
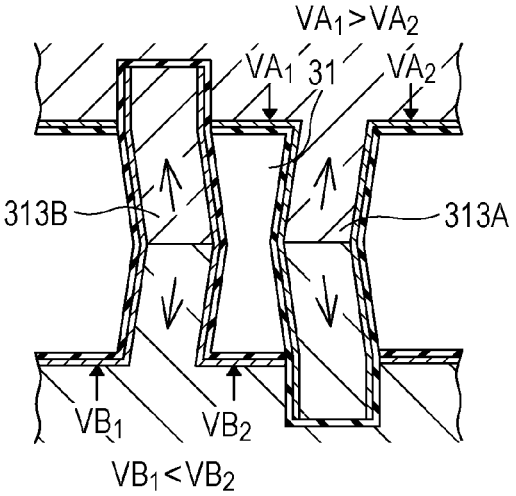
FIG. 16C is a schematic diagram to describe the displacement of the piezoelectric elements and the deformation of the pressure chamber in the event of voltage being applied to the electrodes, relating to the third embodiment.

Next, operations of the inkjet head 300 will be described. FIGS. 16A through 16C are schematic diagrams to describe the displacement of the piezoelectric elements 313A and 313B and the deformation of the pressure chamber 31 in the event of voltage being applied to the electrodes. For the purpose of description here, let us say that voltage $VA_1$ is applied to the signal electrode 319$A_1$ via the floor face electrode 320$A_1$, and similarly voltages $VA_2$, $VB_1$, and $VB_2$ are applied to the signal electrodes 319$A_2$, 319$B_1$, and 319$B_2$, respectively.

FIG. 16A illustrates a so-called ground state where the applied voltage is $VA_1=VA_2$ and $VB_1=VB_2$, and in this state the piezoelectric elements 313A and 313B are not displaced.

Next, FIG. 16B illustrates a state of displacement of the piezoelectric elements 313A and 313B and deformation of the pressure chamber 31 when the applied voltage is $VA_1<VA_2$, and the applied voltage is $VB_1>VB_2$. The voltage $VA_1-VA_2$ and voltage $VB_1-VB_2$ are applied in the direction that is orthogonal to the direction of polarization, and the piezoelectric elements 313A and 313B are subjected to shear deformation. In this case, the piezoelectric elements 313A and 313B are displaced in a dog-leg manner in the direction of the cross-sectional area of the pressure chamber 31 expanding. By applying voltage to the piezoelectric elements 313A and 313B in this manner, the inside of the pressure chamber 31 can be filled with ink Next, FIG. 16C illustrates a state of displacement of the piezoelectric elements 313A and 313B and deformation of the pressure chamber 31 when the applied voltage is $VA_1>VA_2$, and the applied voltage is $VB_1<VB_2$. In this case, the piezoelectric elements 313A and 313B are displaced in a dog-leg manner in the direction of the cross-sectional area of the pressure chamber 31 reducing. By applying voltage to the piezoelectric elements 313A and 313B in this manner, the ink inside of the pressure chamber 31 is pressurized, and ink can be discharged from the discharge openings 330*a* (FIG. 12).

Now, the displacement amount of the piezoelectric elements 313A and 313B are approximately proportional to the pressure chamber height H, i.e. the displacement region of the piezoelectric elements 313A and 313B. Accordingly, in order to suppress uneven displacement amounts among the pressure chambers 31, unevenness in the pressure chamber heights H has to be suppressed. Additionally, as illustrated in FIG. 16C, in the event of reducing the pressure chamber 31, if the pressure chamber widths W differ, the pressure applied to the ink also differs. Accordingly, in order to suppress the unevenness of the ink application pressure among the pressure chambers 31, unevenness in the pressure chamber widths W has to be suppressed.

According to the present embodiment, the first groove 317A functions as a position-determining grove to determine the position in the width direction B of the second piezoelectric element 313B, and the second groove 317B functions as a position-determining grove to determine the position in the width direction B of the first piezoelectric element 313A. Accordingly, the tip portion 316A of the first piezoelectric element 313A is engaged with the second groove 317B, and the tip portion 316B of the second piezoelectric element 313B is engaged with the first groove 317A, whereby the positions in the width direction B of the piezoelectric elements 313A and 313B are determined. Thus, unevenness in the widths W of the pressure chambers 31 can be reduced.

Further, the tip portion 316A of the first piezoelectric element 313A is engaged with the second groove 317B, and the tip portion 316B of the second piezoelectric element 313B is engaged with the first groove 317A. Thus, the unevenness in height in the protruding direction C (FIG. 4) of the piezoelectric elements 313A and 313B is absorbed by the depth of the grooves 317A and 317B. Thus, the unevenness in height H of the pressure chambers 31 can be reduced. Note that by adjusting the amount of engaging of the piezoelectric elements 313A and 313B, the height H can be adjusted to a desired value.

Accordingly, the unevenness of widths W and heights H can be reduced, whereby the unevenness in the cross-sectional area H*W of the pressure chambers 31, i.e. the volume of the pressure chambers 31, can be reduced. Since unevenness in the pressure chamber height H and the pressure chamber width W between pressure chambers 31 can be reduced, unevenness in the ink flying capabilities between discharge openings 330*a* can be reduced.

Also, in order for the piezoelectric elements 313A and 313B to be displaced in a dogleg shape, the base end portions and tip portions of the piezoelectric elements 313A and 313B have to be restrained so as to not move. Also, even if restrained, if the rigidity of the restraining portion is low, the restraining portion can warp in the event of displacement of the piezoelectric element, and can result in the reduction of displacement speed and displacement amount.

According to the present embodiment, the base end portions of the piezoelectric elements 313A and 313B are formed so as to be integrated with the member base portions 12A and 12B, and the tip portions have the tip side face portions engaged with the grooves 17B and 17A and thereby joined, so both end portions of the piezoelectric elements 313A and 313B are restrained with high rigidity. Also, rigidity of the joining region itself can be improved by the floor face electrode 320 and protective insulating film 321. Accordingly, both end portions of the piezoelectric elements 313A and 313B that serve as the restraining portions are configured to secure sufficient rigidity. Accordingly, the piezoelectric elements 313A and 313B become actuators having excellent displacement properties, and excellent ink flying capabilities can be realized.

Also, according to the present embodiment, the piezoelectric element 313A (313B) is made up of a base end piezoelectric portion 313Aa (313Ba) and a tip piezoelectric portion 313Ab (313Bb) of which the polarization direction is in the opposite direction from the base end piezoelectric portion 313Aa (313Ba). Accordingly, a portion of the tip piezoelectric portion 313Ab (313Bb), serving as the tip portion 316A (316B) of the piezoelectric element 313A (313B), is configured to engage with the groove 317B (317A) (see FIG. 14). That is to say, the piezoelectric element 313A (313B) is a shear mode type in a so-called chevron configuration, and one side of the restraining face (the tip portion) is configured to be engaged with the groove. A portion of the tip piezoelectric portion 313Ab (313Bb) is set to be a non-displacement region, and the remaining portions are displacement regions. According to the configuration herein, the grooves 317A and 317B also act as grooves to improve the rigidity of the joining portions of the tip portions of the piezoelectric elements 313A and 313B, whereby the restraining of the piezoelectric elements 313A and 313B in the non-displacement regions can be strengthened, and displacement properties can be improved.

Next, a manufacturing method of the discharging unit 310 according to the present embodiment will be described. According to the present embodiment, the first member 311A and second member 11B may be made of the same material, and the manufacturing method of the materials may be the same.

Figure 17:
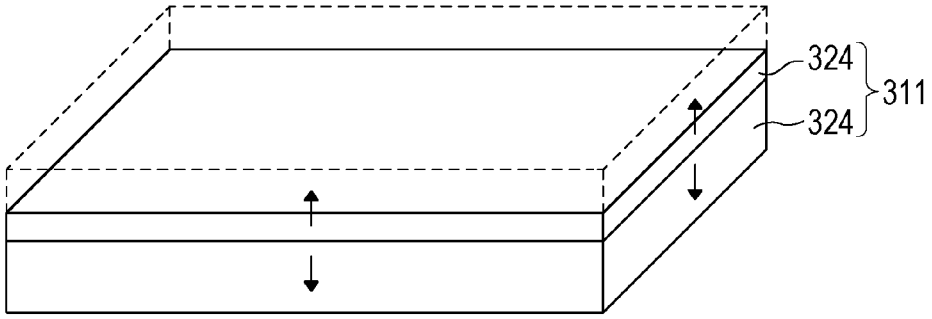
FIG. 17 is a diagram to describe a manufacturing method of the discharging unit relating to the third embodiment.

First, the members 311A and 311B will be described. The piezoelectric element substrates 324 that have been subjected to polarization processing are each reversed and pasted together, then processed to desired dimensions by processing such as grinding, thus yielding a member 311 (see FIG. 17).

Figure 18:
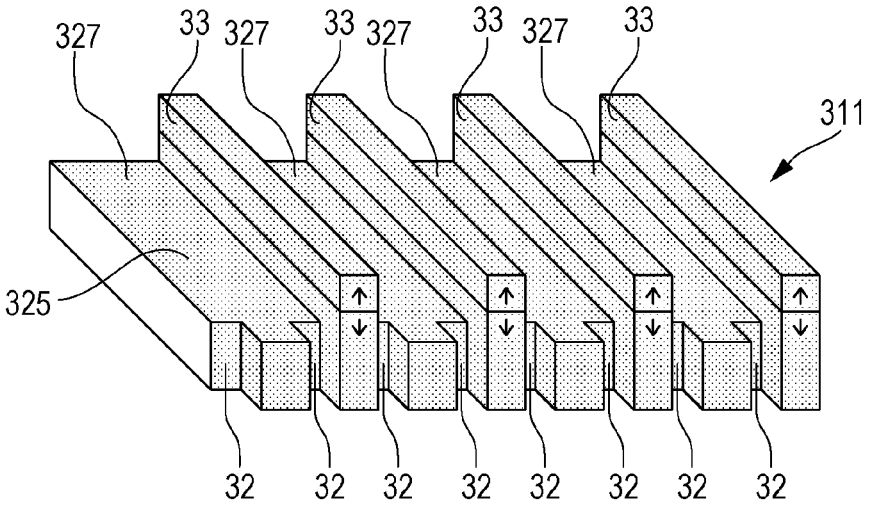
FIG. 18 is a diagram to describe a manufacturing method of the discharging unit relating to the third embodiment.

Next, as illustrated in FIG. 18, by processing a dividing wall groove 327 in the member 311, a side wall (dividing wall) 33 serving as a piezoelectric element (actuator) is formed, which the back face groove 32 is processed. For the groove processes herein, it is favorable to use cutting work with a diamond blade, for example, such that the member 311 does not reach Curie temperature at the time of processing. However, the back face groove 32 is not a region that will later operate as an actuator, so laser processing or the like may be used, which does not take the Curie temperature of the member 311 into account.

Figure 19:
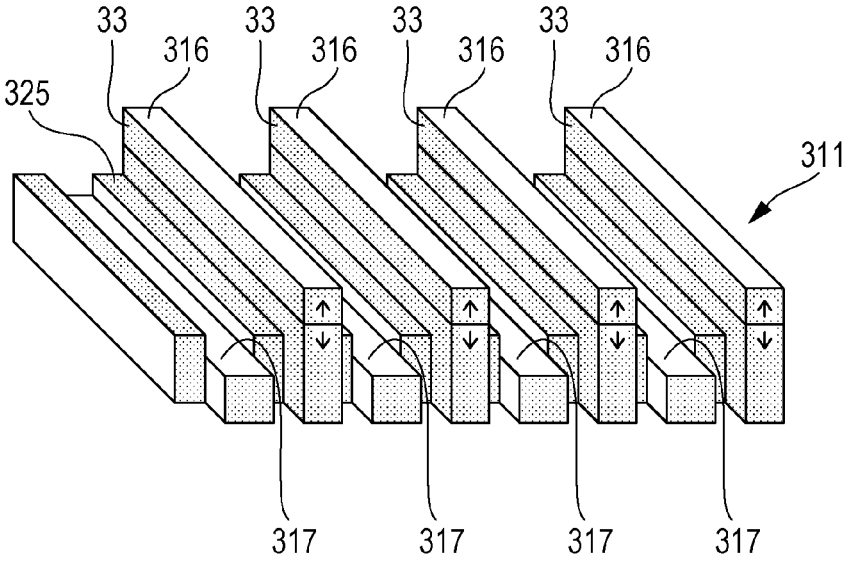
FIG. 19 is a diagram to describe a manufacturing method of the discharging unit relating to the third embodiment.

Next, a conductive layer 325 is applied to the entire face, for example, including the inner portions of the dividing wall groove 327 of the member 311 of which processing of the dividing wall groove 327 has been performed. This can be readily realized by electroless plating or the like. Subsequently, as illustrated in FIG. 19, the conductive layer 325 on the upper face (tip portion) 316 of the side wall (dividing wall) 33 can be selectively removed by polishing or the like, and the groove 317 is processed so as to further segment the conductive layer 325 within the dividing wall groove 327. Note that it is favorable for the groove 317 processed here to have a width set that is approximately the same as the width of the side wall (dividing wall) 33, and it is favorable for these to be formed with cutting work with a diamond blade, as described above. Also, subsequently, a protective insulating film is applied to the entire forming face of the side wall (dividing wall) 33 with a sputtering method or the like, though unshown.

Figure 20:
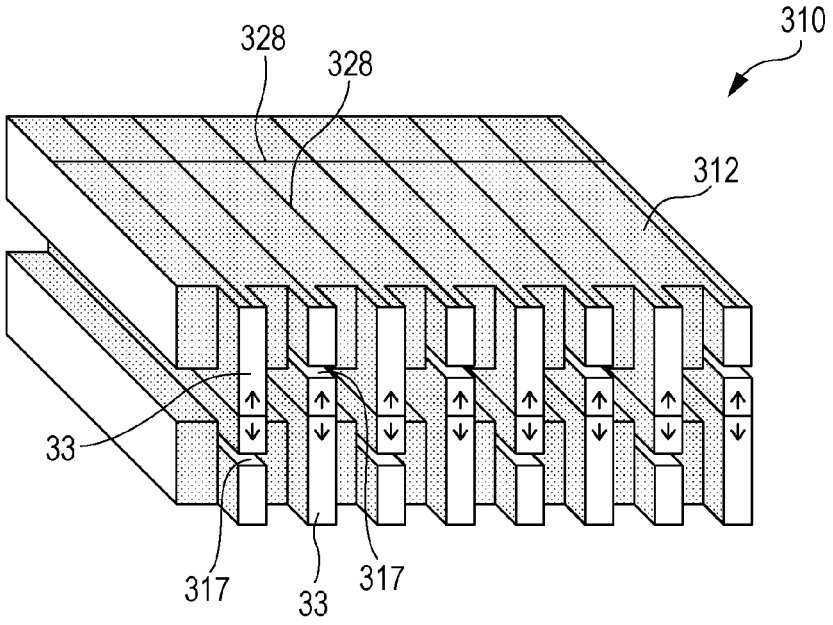
FIG. 20 is a diagram to describe a manufacturing method of the discharging unit relating to the third embodiment.

Next, the upper face 16 of the side wall (dividing wall) 33 is coated uniformly with an elastic member (e.g. an adhesive), a similarly prepared member 311 is faced thereto, and as illustrated in FIG. 20, the tip portion of the side wall (dividing wall) 33 is engaged with the groove 317, and the discharging unit 310 is obtained.

Subsequently, the front face and back face of the discharging unit 310 is ground and polished, and adjusted to the desired dimension, while the conductive layer 325 is removed. Also, lead-out electrode segmenting grooves 328 are processing as to the upper face of the discharging unit 310, and individual electrodes 312 that are each electrically segmented are obtained.

According to the above-described series of processes, upon forming the discharging unit 310, pasting of the nozzle plate 330, back face plate 340, manifold 350, flexible substrates 360 and 370, and so forth is performed as illustrated in FIG. 12. This leads to the inkjet head 300 according to the present embodiment.

According to the present embodiment, the first member 311A and second member 311B may use the member 311 having the same configuration, i.e. the second member 311B may use the member having the same configuration as the first member 311A but rotated by 90 degrees. Thus, in order to manufacture the two members 311A and 311B, members having other configurations do not have to be manufactured, whereby manufacturing processes can be simplified and manufacturing costs can be reduced.

Note that the present invention is not restricted to the embodiment described above, and numerous modifications can be made within the technical scope of the present invention by one who is skilled in the art.

Also, the above embodiment describes a case wherein the piezoelectric element is configured such that two polarized piezoelectric portions are pasted together so as to be mutually in opposite directions, but the present invention is not restricted to this. Even in a case where the piezoelectric element is made of one polarized piezoelectric portion in a direction parallel to the protruding direction, the present invention is applicable.

Also, the present embodiment describes an inkjet head used for a printer or the like to serve as the liquid discharge head, but the present invention is not restricted to this, and a head that discharges liquid which includes metallic particles used in the event of forming metal wiring as liquid may be used.

EXAMPLES

Example 1

As a discharging unit 10 (see FIG. 4) described with the first embodiment, a piezoelectric substrate 11 was formed by cutting processing and electroless plating, using piezoelectric ceramic C-6 manufactured by Fuji Ceramics Corporation as the piezoelectric material. Also, a cover plate 21 from the groove 23 being subjected to cutting processing, using the piezoelectric ceramic C-6.

As an adhesive 25, Epoxy adhesive 1077B manufactured by TESK Co. Ltd (Young's Modulus: approximately 2 GPa) was used. Now, changes to vibration properties when the length D of the tip side face portion is changed was observed, using a thickness L of the piezoelectric element 13 of 60 micrometers, height H of the pressure chamber 1 of 140 micrometers, and space W between the tip side face portion 18 of the tip portion 16 of the piezoelectric element 13 and the inner side face portion 28 of the groove 23 as 5 micrometers. For vibration measurement, observation was made using a laser Doppler frequency device, and the natural frequency, deformation amount, and deformation speed of the piezoelectric element 13 when 10 V was applied were each evaluated.

Figure 7A:
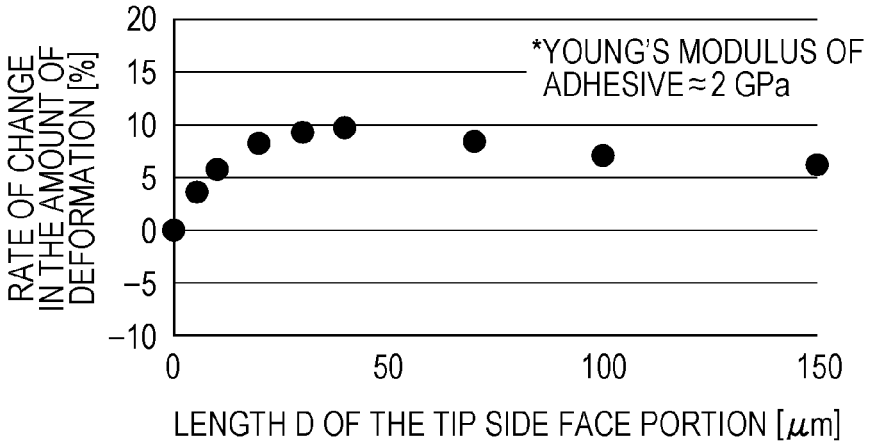
FIG. 7A is a diagram illustrating the relation between the vibration properties of the piezoelectric elements and the depth of the groove in an inkjet head relating to the first embodiment.
Figure 7B:
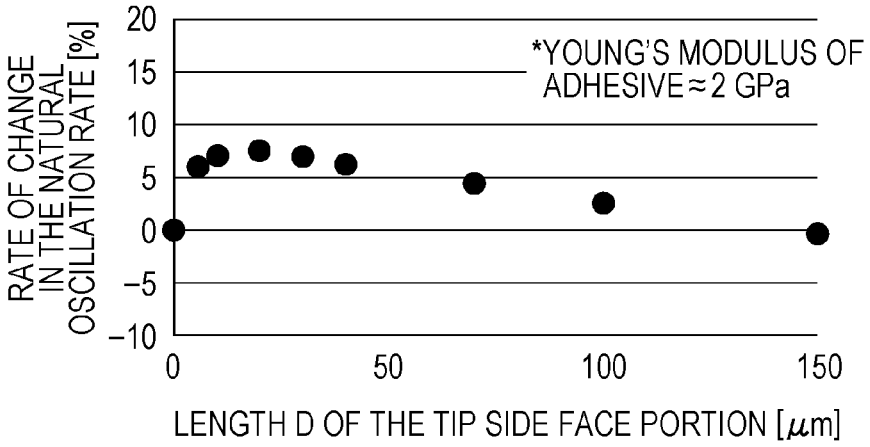
FIG. 7B is a diagram illustrating the relation between the vibration properties of the piezoelectric elements and the depth of the groove in an inkjet head relating to the first embodiment.
Figure 7C:
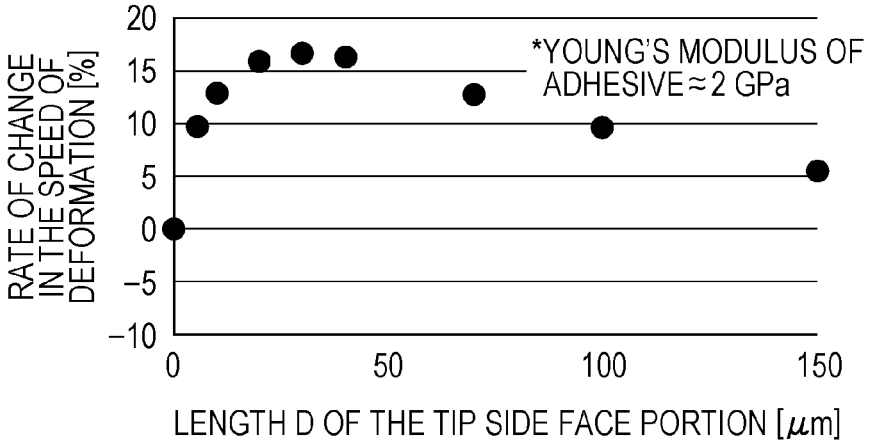
FIG. 7C is a diagram illustrating the relation between the vibration properties of the piezoelectric elements and the depth of the groove in an inkjet head relating to the first embodiment.

FIGS. 7A through 7C illustrate the dependency of the length D of the tip side face portion on the vibration properties of the piezoelectric element 13 in the first example. FIGS. 7A, 7B, and 7C illustrate the dependency of the depth D of the groove 23 on the deformation amount when 10 V is applied, the natural frequency, and the deformation speed, respectively. Note that the vertical axis in each graph represents the rate of change as to the deformation amount, natural frequency, and deformation speed when the length D of the tip side face portion is 0.

As illustrated in FIG. 7A, the deformation amount of the piezoelectric element 13 in the first example is at maximum when the groove depth D is set to 40 micrometers, and compared to a case of having not a groove 23, the deformation amount improves by approximately 10%. Even if the groove depth D is 150 micrometers, i.e. approximately the same depth as the height H of the pressure chamber 1, an improvement in the deformation amount of approximately 5% was observed. Thus, it was suggested that the piezoelectric element 13 is deformed even within the groove 23 which is restrained by the adhesive 25.

Also, as illustrated in FIG. 7B, the natural frequency of the piezoelectric element 13 in the first example is at maximum when the groove depth D is set to 20 micrometers, and improves by approximately 7%. However, in the case of setting the groove depth D to 150 micrometers, the natural frequency decreases by approximately 1%. Thus, it was suggested that changes in the natural frequency occur as a combination of rigidity decrease from the piezoelectric element 13 lengthening and rigidity increase of the restraining portion by the restraining region widening.

As illustrated in FIG. 7C, the deformation speed of the piezoelectric element 13 in the first example is at maximum when the groove depth D is set to 30 micrometers, and improved by approximately 17%. Also, even if the groove depth D is 150 micrometers, the deformation speed increase amount had improved by approximately 5%. Thus, it was suggested that even in the case of an excessively deep groove depth D, resulting in decreased natural frequency, if the improvement effect in deformation amount is sufficient the improvement effect of the resulting deformation speed is maintained.

Thus, according to the configuration of the discharge unit 10 according to the first example, an inkjet head with a faster shear deformation speed, wherein ink I can be pressured more quickly within the pressure chamber 1, can be provided.

Example 2

Using a similar configuration as the discharging unit 10 described in the first example, similar evaluations were performed, modifying only the adhesive 25. Note that the adhesive 25 used in the second example is a filtered TB2270C manufactured by Three Bond. The Young's Modulus after filtering the adhesive 25 was approximately 10 GPa.

Figure 8:
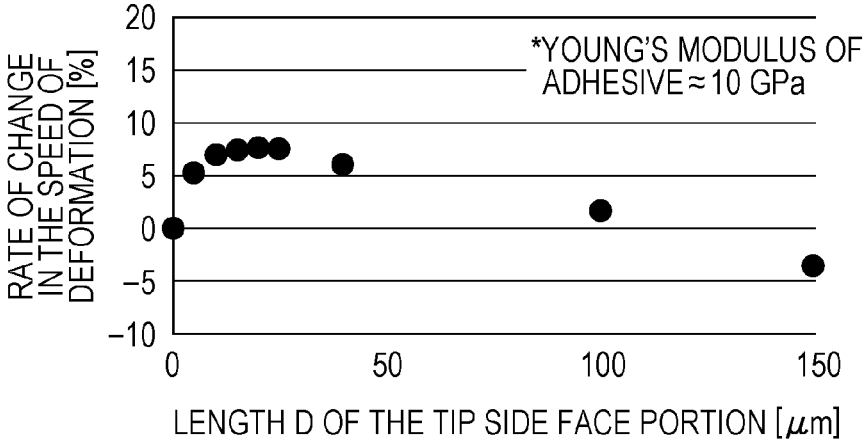
FIG. 8 is a diagram illustrating the dependence of groove depth to deformation speed of the piezoelectric elements in an inkjet head relating to a second embodiment.

FIG. 8 illustrates the dependency of the groove 23 depth D on the deformation speed of the piezoelectric element 13 when 10 V is applied, with the second embodiment. Note that the vertical axis in each graph represents the rate of change as to the deformation speed from when the length D of the tip side face portion is 0.

The deformation speed of the piezoelectric element 13 in the second example is at maximum when the length D of the tip side face portion is set to 20 micrometers, and compared to a case of having not a groove 23, the deformation speed improves by approximately 7%. However, this result is an improvement effect of approximately 10% lower than the result shown in FIG. 7C in the first example. Further, if the length D of the tip side face portion is set to 150 micrometers, the deformation speed decreased by approximately 4% as compared to not having a groove 23. Thus, it was suggested that when the Young's Modulus of the adhesive 25 is increased, the deformation amount of the piezoelectric element 13 in the engaging portion is decreased.

However, it is determined that, by appropriately setting the length D of the tip side face portion, even in a case of using an adhesive 25 with a high Young's Modulus, an inkjet head with a faster shear deformation speed can be provided.

Example 3

Figure 21A:
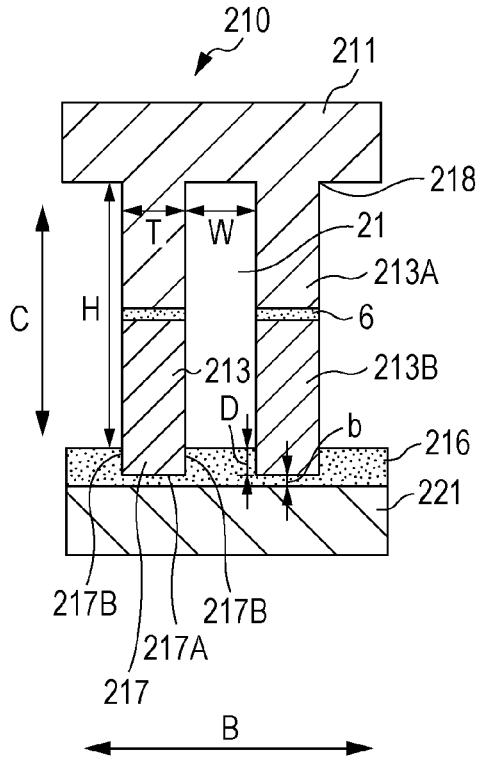
FIG. 21A is a diagram illustrating a partial cross-section of the discharging unit relating to the third embodiment.
Figure 21B:
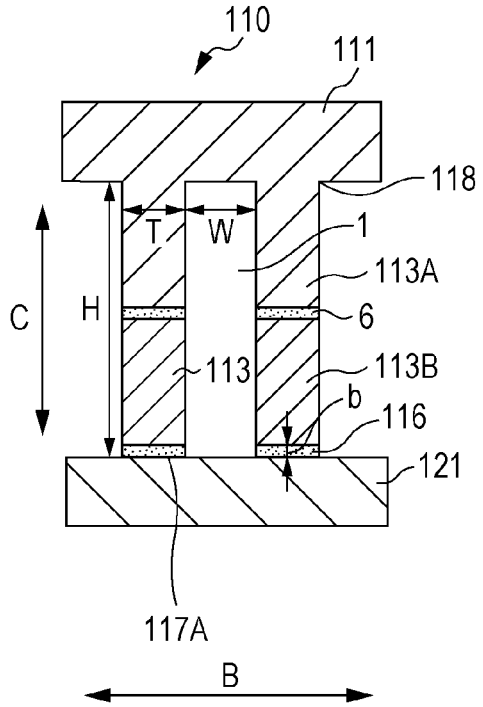
FIG. 21B is a diagram illustrating a partial cross-section of the discharging unit relating to the third embodiment.

FIGS. 21A and 21B are schematic diagrams illustrating a partial cross-section of the discharging unit. FIG. 21A illustrates a configuration of the discharging unit 210 described with the second embodiment, where the tip side face portion 217B of the tip portion 217 is embedded in the adhesive layer 216 that uniformly coats the substrate 221.

FIG. 21B illustrates a conventional configuration, where a piezoelectric substrate 111 provided with multiple piezoelectric elements 113 which have piezoelectric bodies 113A and 113B of the same height is created, after which the adhesive coated on the glass substrate by screen printing is transferred to the tip face 117A. Subsequently, the tip face 117A and substrate 121 are joined and the adhesive is hardened to form the adhesive layer 116, thereby forming the discharging unit 110.

In FIGS. 21A and 21B, the thicknesses b of the adhesive layer 6, adhesive layer 216, and adhesive layer 116 are set to be the same. The width W of the pressure chamber 21 and pressure chamber 11, the width T of the piezoelectric element, and the height H of the pressure chamber, are also set to be the same. However, in order to even out the displacement region of the pressure chamber, the height H of the pressure chamber is set to be the height from the base end portion 118 to the tip face 117A in a conventional configuration, and the difference in height between the height from the base end portion 218 to the tip face 217A and the length D of the tip side face portion 217B according to the configuration in the present example. Also, adhesive materials and piezoelectric materials used are each the same.

Upon manufacturing each of the discharging units 210 and 110, the natural frequencies thereof were measured by an impedance analyzer. The displacement amount of the piezoelectric elements 213 and 113 were measured with a laser Doppler measurement. The vibration properties were calculated from the product of the obtained natural frequencies and displacement amounts, and a comparison was performed between the configuration according to the present example and a conventional configuration.

Figure 22A:
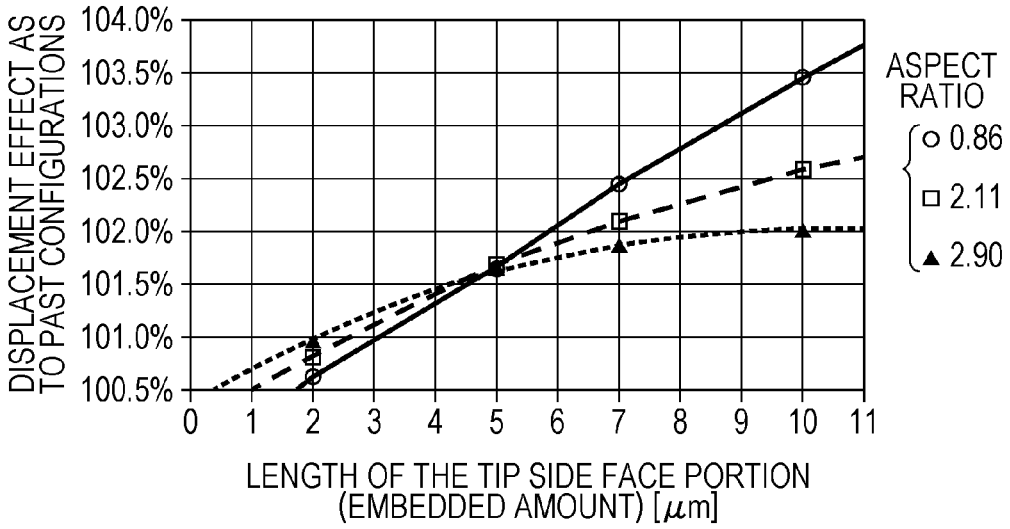
FIG. 22A is a diagram illustrating advantages of the vibration properties relating to the third embodiment.
Figure 22B:
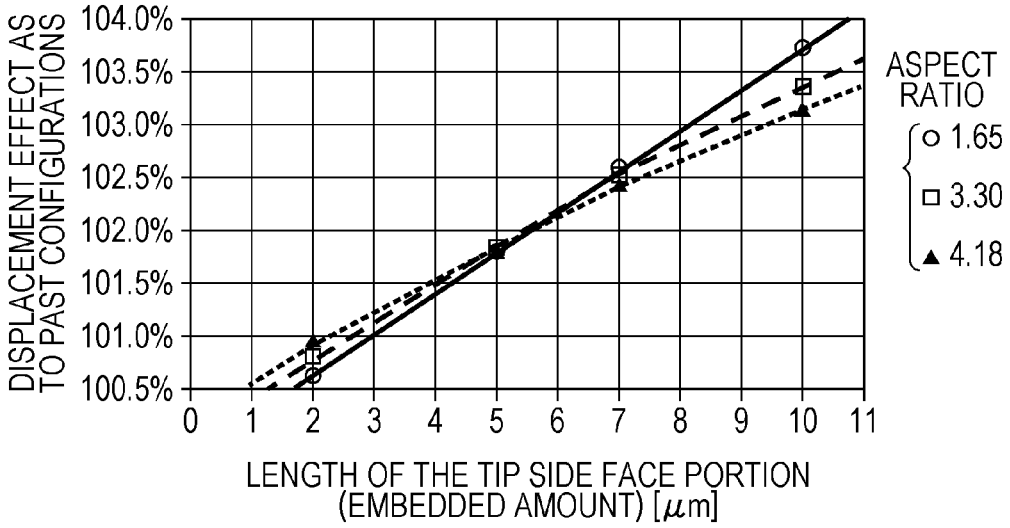
FIG. 22B is a diagram illustrating advantages of the frequency properties relating to the third embodiment.

FIGS. 22A and 22B are diagrams comparing the displacement amount of the piezoelectric element 213 when the length (embedded amount) D of the tip side face portion 217B is changed in a configuration according to the present example, and the displacement amount of the piezoelectric element 113 according to a conventional configuration. The displacement amount of the piezoelectric element 213 in a configuration according to the present example was divided by the displacement amount of the piezoelectric element 113 according to a conventional configuration, and the diagram indicates that if the result is 100% or greater, the displacement amount is greater than in a conventional configuration and the displacement effect is greater. FIGS. 22A and 22B illustrate that the configuration according to the present invention where the tip portion is embedded in the adhesive layer has a greater displacement effect than in a conventional configuration.

Also, FIG. 22A illustrates that when the length (embedded amount) D of the tip side face portion reaches 5 micrometers, the relation between the aspect ratio R and displacement effect becomes inverted. That is to say, when the length (embedded amount) D of the tip side face portion is smaller than 5 micrometers, the displacement effect decreases as the aspect ratio R increases, as compared to when the length is 5 micrometers or greater. When the length (embedded amount) D of the tip side face portion is 5 micrometers or greater, the displacement effect improves as the aspect ratio R decreases.

The examples demonstrate that the vibration properties of the present configuration have significant advantages when the aspect ratio R is at or lower than a certain value. Generally aspect ratio R and displacement amount are in an inversely proportional relationship. On the other hand, a certain amount of displacement has to take place in order to discharge the droplets.

Based on the above-described reasons, even in the case of a low aspect ratio R, a length (embedded amount) D of the tip side face portion that works in the direction to maintain a fixed displacement amount is necessary, so it is desirable for the length (embedded amount) D of the tip side face portion to be 5 micrometers or greater.

FIG. 22B is a diagram similar to FIG. 22A of a 4 GPa Young's Modulus, and in the event that the aspect ratio R is decreased when at 5 micrometers or greater, the displacement effect tends toward increasing.

Accordingly, taking into consideration the above-described results, it is desirable for the aspect ratio R (=H/T) to be 4.0 or less, and the length (embedded amount) D of the tip side face portion to be 5 micrometers or greater and 20 micrometers or less.

In the case of using a region having a higher aspect ratio, it is desirable for the aspect ratio R (=H/T) to be 4.9 or less, the Young's Modulus E to be 20 GPa or less, and the embedded amount D to be 5 micrometers or greater and 15 micrometers or less.

Figure 23A:
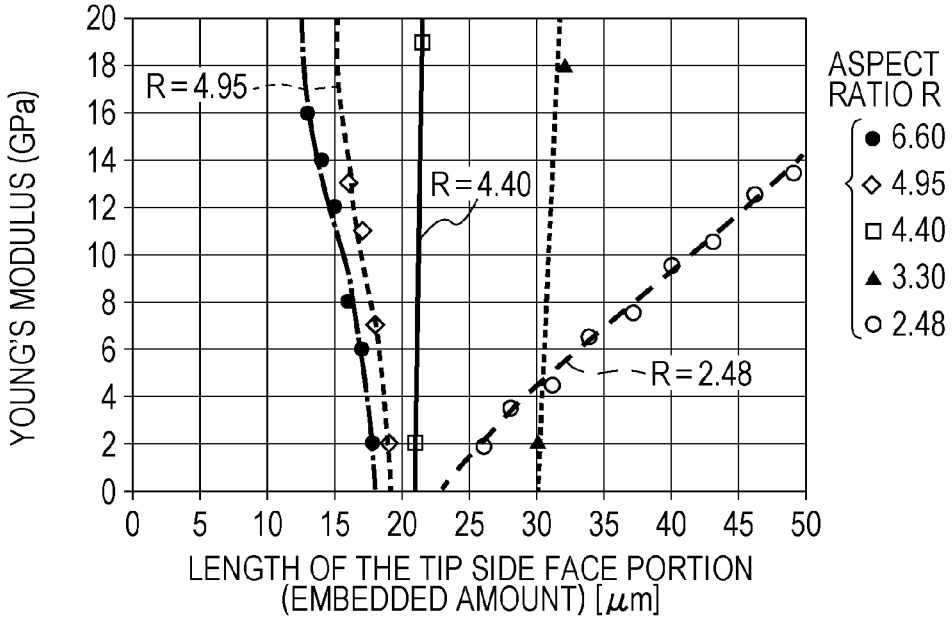
FIG. 23A is a diagram comparing the displacement amount of the piezoelectric elements when the embedded amount in the configuration according to the third embodiment is changed and the displacement amount of the piezoelectric elements of a conventional configuration.
Figure 23B:
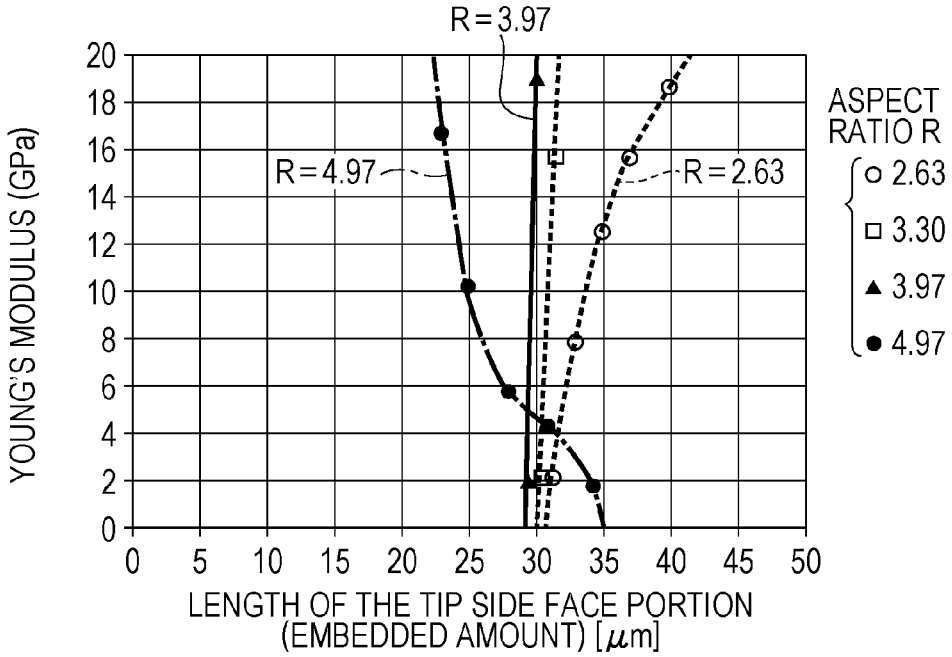
FIG. 23B is a diagram comparing the displacement amount of the piezoelectric elements when the embedded amount in the configuration according to the third embodiment is changed and the displacement amount of the piezoelectric elements of a conventional configuration.

FIGS. 23A and 23B illustrate the relation between the length D of the tip side face portion and the Young's Modulus E of the adhesive layer when the vibration properties match in a configuration according to the present example (FIG. 21A) and a conventional configuration (FIG. 21B).

The curves shown in FIG. 23A are plots of the length (embedded amount) D of the tip side face portion (FIG. 21A) and the Young's Modulus E of the adhesive layer 216 when the vibration properties in a configuration according to the present example and the vibration properties in a conventional configuration match. If in a region to the left side of the curve, this indicates that the configuration according to the present example has higher vibration properties than in a conventional configuration.

Each plot indicates when the aspect ratio R (=H/T) is changed, and the lower the aspect ratio R, the wider the region having a higher effect of vibration properties than a conventional configuration becomes. The aspect ratio R is adjusted by fixing the pressure chamber height H and changing the piezoelectric element width T.

FIG. 23B illustrates similar curves as FIG. 23A. However, the aspect ratio R is adjusted by fixing the width T of the piezoelectric element 213 and changing the height H of the pressure chamber 21. Similar to FIG. 23A, the lower the aspect ratio R becomes, the wider the region having a higher effect of vibration properties than a conventional configuration becomes.

Regardless of the Young's Modulus E of the adhesive layer 216, regions indicating significantly higher advantages in vibration properties than with conventional configurations are obtained when the aspect ratio R is 4.40 or less, and the embedded amount D is 21 micrometers or less, as illustrated in FIG. 23A. Also, as illustrated in FIG. 23B, advantages are exhibited when the aspect ratio R is 3.97 or less and the embedded amount D is 28 micrometers or less.

Accordingly, considering the results above, it is desirable for the aspect ratio R (=H/T) to be 4.0 or less, and for the length (embedded amount) D of the tip side face portion to be 5 micrometers or greater and 20 micrometers or less.

In the case of using a region with a higher aspect ratio, it is desirable for the aspect ratio R (=H/T) to be 4.9 or less, the Young's Modulus E to be 20 GPa or less, and for the embedded amount D to be 5 micrometers or greater and 15 micrometers or less.

Figure 24:
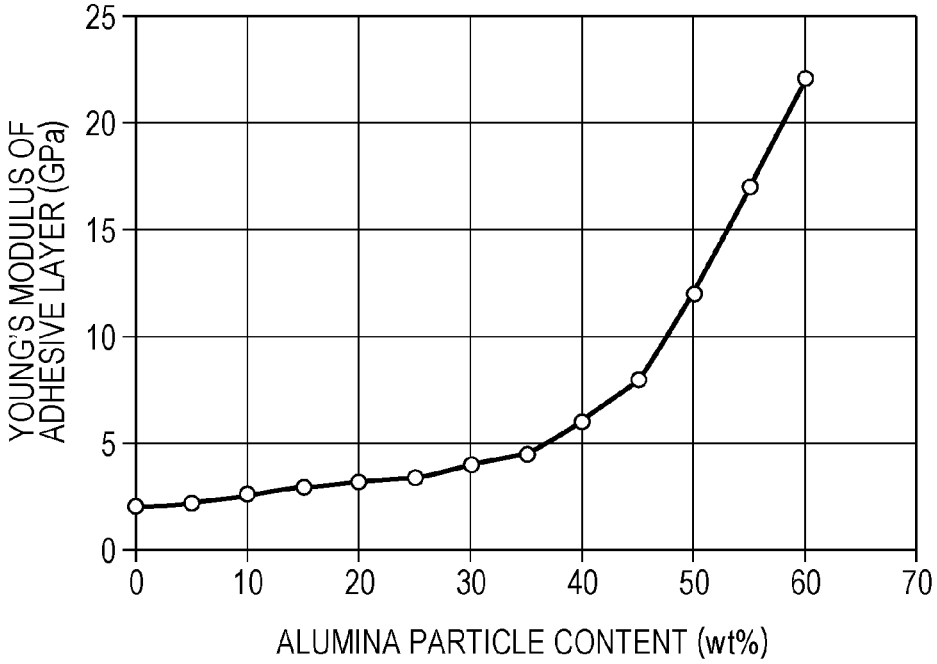
FIG. 24 is a diagram illustrating the properties of an adhesive relating to the third embodiment.

The adhesive layer 216 was formed with an adhesive having an epoxy resin and alumina particles that have been added to the epoxy resin. FIG. 24 is a diagram illustrating properties of the adhesive relating to the examples. FIG. 24 illustrates the relation between the alumina weight ratio and the Young's Modulus in the event that an epoxy base is used as the adhesive layer and alumina particles are used as insulating filler. A two-component epoxy manufactured by Three Bond was used as the epoxy base, and TM-DA manufactured by Taimei Chemicals Co., Ltd. was used for the alumina particles. We can see that the Young's Modulus improves when the fill density of the alumina particles is increased. That is to say, the Young's Modulus of an epoxy resin adhesive layer is generally approximately 2 GPa at the highest, but by adding alumina particles, the Young's Modulus can be increased to greater than 2 GPa. Thus, since the Young's Modulus of the adhesive layer 216 improves, the joining portion between the tip portion 217 of the piezoelectric element 213 and the one face of the substrate (ceiling plate) 221 is increased in rigidity, and the vibration properties of the piezoelectric element 213 is improved.

Also, the diameter of the alumina particles are a small 0.5 micrometers or less, whereby the thickness b of the adhesive layer between the tip face of the piezoelectric element and the substrate (ceiling plate) can be made thin, of a thickness of 3 micrometers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-252786, filed Nov. 18, 2011, Japanese Patent Application No. 2012-031873, filed Feb. 16, 2012, and Japanese Patent Application No. 2012-163988, filed Jul. 24, 2012, which are hereby incorporated by reference herein in their entirety.

REFERENCE SIGNS LIST

1 Pressure chamber
2 Discharging unit
11 Piezoelectric substrate
12 Member base unit
13 Piezoelectric element
13*a* Base end piezoelectric portion
13*b* Tip piezoelectric portion
16 Tip portion
17 Signal electrode (Electrode)
21 Cover plate (plate member)
23 Groove
25 Adhesive
30*a* Discharge opening
100 Inkjet head (Liquid discharge head)

The invention claimed is:

1. A liquid discharging device comprising: a pressure chamber formed by a first side wall made of a piezoelectric element, a second side wall made of the piezoelectric element, a floor wall or a ceiling wall, and a substrate, wherein an electrode is formed on a face of the first side wall and a face of the second side wall, the faces each facing an inner side of the pressure chamber to apply voltage to the piezoelectric element in order to change a volume of the pressure chamber by deforming the piezoelectric element;

a liquid supplying unit provided on a liquid supply side of the pressure chamber to supply the pressure chamber with liquid; and a nozzle plate provided on a liquid discharge side of the pressure chamber and having a hole through which the liquid of the pressure chamber is discharged, wherein the first side wall and the second side wall provided with the electrode are joined via an elastic member to the substrate, and wherein the elastic member covers a part of a side of the first side wall and a part of a side of the second side wall, the sides each facing the substrate, and the electrode is formed also on the covered first and second side walls.

2. The liquid discharging device according to claim 1, wherein the floor wall or the ceiling wall is made up of the piezoelectric element, of which the first side wall and the second side wall are formed.

3. The liquid discharging device according to claim 1, wherein a plurality of pressure chambers are provided, and liquid is discharged from the plurality of pressure chambers.

4. The liquid discharging device according to claim 1, wherein a groove is formed on the substrate, and an inner side face portion of the groove, the tip side face portion of the first side wall provided with the electrode, and the tip side face portion of the second side wall provided with the electrode are joined together via the elastic member.

5. The liquid discharging device according to claim 4, wherein a length of the tip side face portion of the first side wall restrained via the elastic member to the substrate is 20 micrometers or greater and 60 micrometers or less.

6. The liquid discharging device according to claim 1, wherein the substrate has an adhesive layer thereupon, and the tip side face portions are embedded in the adhesive layer.

7. The liquid discharging device according to claim 6, wherein the adhesive layer has a Young's Modulus that is smaller than that of the piezoelectric element.

8. The liquid discharging device according to claim 7, wherein the adhesive layer is formed of an adhesive having an epoxy resin and alumina particles that are added to the epoxy resin.

9. The liquid discharging device according to claim 6, wherein, when a length of the tip side face portions of the piezoelectric element is D, a width of the piezoelectric element is T, and a height of the pressure chamber is H, then H/T is 4.0 or less, and D is 5 micrometers or greater and 20 micrometers or less.

10. The liquid discharging device according to claim 6, wherein, when a length of the tip side face portions of the piezoelectric element is D, a width of the piezoelectric element is T, a height of the pressure chamber is H, and a Young's Modulus of the adhesive layer is E, then H/T is 4.9 or less, E is 20 GPa or less, and D is 5 micrometers or greater and 15 micrometers or less.

11. The liquid discharging device according to claim 1, wherein the piezoelectric element is formed with a base end piezoelectric portion that is polarized in a first direction parallel to the tip side face portions, and a tip piezoelectric portion that is polarized in a second direction which is the opposite direction from the first direction, in an integrated manner.

12. The liquid discharging device according to claim 1, wherein the piezoelectric element is formed with a base end piezoelectric portion that is polarized in a first direction parallel to the tip side face portions, and a tip piezoelectric portion that is polarized in a second direction which is the opposite direction from the first direction, in a joined manner.

13. The liquid discharging device according to claim 11, wherein the tip piezoelectric portion is formed to be longer in the second direction than the base end piezoelectric portion.

* * * * *